US012637839B2

(12) United States Patent
Nagao et al.

(10) Patent No.: US 12,637,839 B2
(45) Date of Patent: May 26, 2026

(54) WORK VEHICLE, CONTROLLER FOR WORK VEHICLE, AND SPEED CONTROL METHOD FOR WORK VEHICLE

(71) Applicant: KUBOTA CORPORATION, Osaka (JP)

(72) Inventors: Kohei Nagao, Sakai (JP); Ryota Hamamoto, Sakai (JP); Daiki Abe, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 50 days.

(21) Appl. No.: 18/773,575

(22) Filed: Jul. 16, 2024

(65) Prior Publication Data

US 2025/0027293 A1 Jan. 23, 2025

(30) Foreign Application Priority Data

Jul. 21, 2023 (JP) ..... 2023-118988

(51) Int. Cl.
*E02F 9/22* (2006.01)
*E02F 9/20* (2006.01)

(52) U.S. Cl.
CPC ..... *E02F 9/2203* (2013.01); *E02F 9/2004* (2013.01); *E02F 9/2235* (2013.01); *E02F 9/2253* (2013.01)

(58) Field of Classification Search
CPC ..... E02F 9/2004; E02F 9/2235; E02F 9/2253
See application file for complete search history.

(56) References Cited

U.S. PATENT DOCUMENTS

| | | | | |
|---|---|---|---|---|
| 11,198,988 | B1 * | 12/2021 | Zimmerman | F15B 11/17 |
| 2014/0114535 | A1 * | 4/2014 | Ohmae | B62D 5/091 701/42 |
| 2014/0200775 | A1 * | 7/2014 | Shirao | B60W 10/06 701/50 |
| 2017/0151979 | A1 * | 6/2017 | Maeda | B62D 5/0481 |
| 2024/0060274 | A1 | 2/2024 | Nagao et al. | |

FOREIGN PATENT DOCUMENTS

| | | | |
|---|---|---|---|
| CN | 212509039 U | * | 2/2021 |
| JP | 2017-053413 | | 3/2017 |
| JP | 2020-038002 | | 3/2020 |
| JP | 2024-029566 | | 3/2024 |

* cited by examiner

*Primary Examiner* — Scott A Browne
*Assistant Examiner* — Josephine Elizabeth Rich
(74) *Attorney, Agent, or Firm* — MORI & WARD, LLP

(57) ABSTRACT

A work vehicle includes a human-machine interface configured to receive an input corresponding to a target rotation speed of a hydraulic motor. A rotation speed sensor is configured to detect a rotation speed of the hydraulic motor. A hydraulic control circuit is configured to control a hydraulic pressure of pilot oil to change a displacement volume of the hydraulic pump. Circuitry is configured to control a prime mover and the hydraulic control circuit. The circuitry is configured to obtain based on the target rotation speed, a reference value of a control parameter according to which the hydraulic control circuit is controlled, calculate a speed difference obtained by subtracting the target rotation speed from the rotation speed, calculate an offset value corresponding to the speed difference, and set the control parameter to a value obtained by adding the offset value to the reference value.

19 Claims, 18 Drawing Sheets

WORK VEHICLE, CONTROLLER FOR WORK VEHICLE, AND SPEED CONTROL METHOD FOR WORK VEHICLE

CROSS-REFERENCE TO RELATED APPLICATIONS

The present application claims priority under 35 U. S. C. § 119 to Japanese Patent Application No. 2023-118988, filed Jul. 21, 2023. The contents of this application are incorporated herein by reference in their entirety.

BACKGROUND OF THE INVENTION

Field of the Invention

The present invention relates to a work vehicle, a controller for the work vehicle, and a speed control method for the work vehicle.

Discussion of the Background

Japanese Patent Application Laid-Open No. 2017-053413 describes a technique of measuring an input of a travel lever and a rotation speed of a travel motor and adjusting a pilot pressure of a travel pump so that the rotation speed of the travel motor matches a command based on the input of the travel lever. Japanese Patent Application Laid-Open No. 2020-038002 describes a method of detecting a primary pressure of pilot oil supplied to a remote control valve and a rotational speed of a travel motor, and controlling the primary pressure so as to achieve a target vehicle speed based on the detected primary pressure and rotational speed.

SUMMARY OF THE INVENTION

In accordance with one aspect of the present invention, a work vehicle includes a hydraulic motor, a hydraulic pump, a prime mover, a human-machine interface, a rotation speed sensor, a hydraulic control circuit, and circuitry. The hydraulic motor is configured to generate a driving force of the work vehicle. The hydraulic pump is configured to supply hydraulic fluid to the hydraulic motor. The prime mover is configured to rotate the hydraulic pump. The human-machine interface is configured to receive an input corresponding to a target rotation speed of the hydraulic motor. The rotation speed sensor is configured to detect a rotation speed of the hydraulic motor The hydraulic control circuit is configured to control a hydraulic pressure of pilot oil to change a displacement volume of the hydraulic pump. The circuitry is configured to control the prime mover and the hydraulic control circuit. The circuitry is configured to obtain based on the target rotation speed, a reference value of a control parameter according to which the hydraulic control circuit is controlled. The circuitry is configured to calculate a speed difference obtained by subtracting the target rotation speed from the rotation speed. The circuitry is configured to calculate an offset value corresponding to the speed difference. The circuitry is configured to set the control parameter to a value obtained by adding the offset value to the reference value.

In accordance with another aspect of the present invention, a controller of a work vehicle includes operation detection circuitry, determination circuitry, pump control circuitry, prime mover control circuitry, and motor rotation detection circuitry. The operation detection circuitry is configured to receive an input from a human-machine interface, the input corresponding to a target rotation speed of a hydraulic motor configured to generate a driving force of the work vehicle. The determination circuitry is configured to determine a control parameter according to which a displacement volume of a hydraulic pump is controlled in response to an operation of the human-machine interface, the hydraulic pump being configured to supply hydraulic fluid to the hydraulic motor. The pump control circuitry is configured to send a command corresponding to the control parameter to a hydraulic control circuit to control the displacement volume of the hydraulic pump. The prime mover control circuitry is configured to send a command to a prime mover configured to rotate the hydraulic pump to rotate the hydraulic motor via the hydraulic pump. The motor rotation detection circuitry is configured to receive a rotation speed of the hydraulic motor from a rotation speed sensor. The pump control circuitry is configured to calculate a speed difference obtained by subtracting the target rotation speed from the rotation speed. The determination circuitry is configured to obtain a reference value of the control parameter based on the target rotation speed. The determination circuitry is configured to calculate an offset value corresponding to the speed difference. The determination circuitry is configured to set the control parameter to a value obtained by adding the offset value to the reference value.

In accordance with the other aspect of the present invention, a speed control method for a work vehicle includes acquiring from a human-machine interface, a target rotation speed of a hydraulic motor configured to generate a driving force of the work vehicle. The method includes determining a control parameter according to which a displacement volume of a hydraulic pump is set based on an operation of the human-machine interface, the hydraulic pump being configured to supply hydraulic fluid to the hydraulic motor. The method includes controlling the displacement volume of the hydraulic pump according to the control parameter to rotate the hydraulic pump to rotate the hydraulic motor. The method includes detecting a rotation speed of the hydraulic motor and calculating a speed difference obtained by subtracting the rotation speed from the target rotation speed. The method includes obtaining a reference value of the control parameter based on the target rotation speed, calculating an offset value corresponding to the speed difference, and setting the control parameter to a value obtained by adding the offset value to the reference value.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings.

DESCRIPTION OF THE EMBODIMENTS

Citation by Reference

Figure 1:
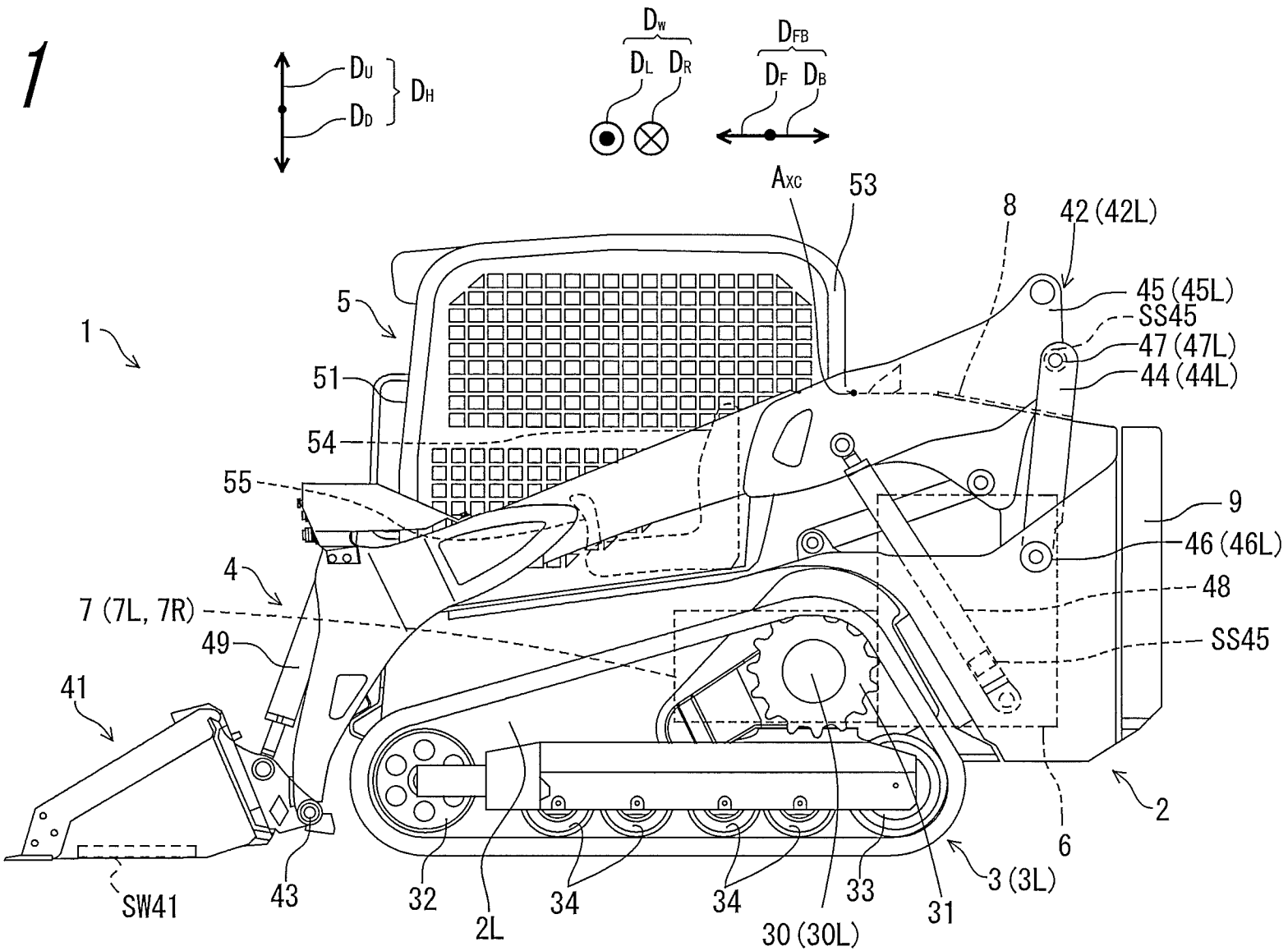
FIG. 1 is a side view of a work vehicle.

The present invention will be described in detail below with reference to the drawings showing embodiments thereof. In the drawings, the same reference numerals denote corresponding or substantially the same components.

First Embodiment

Overall Configuration

Figure 2:
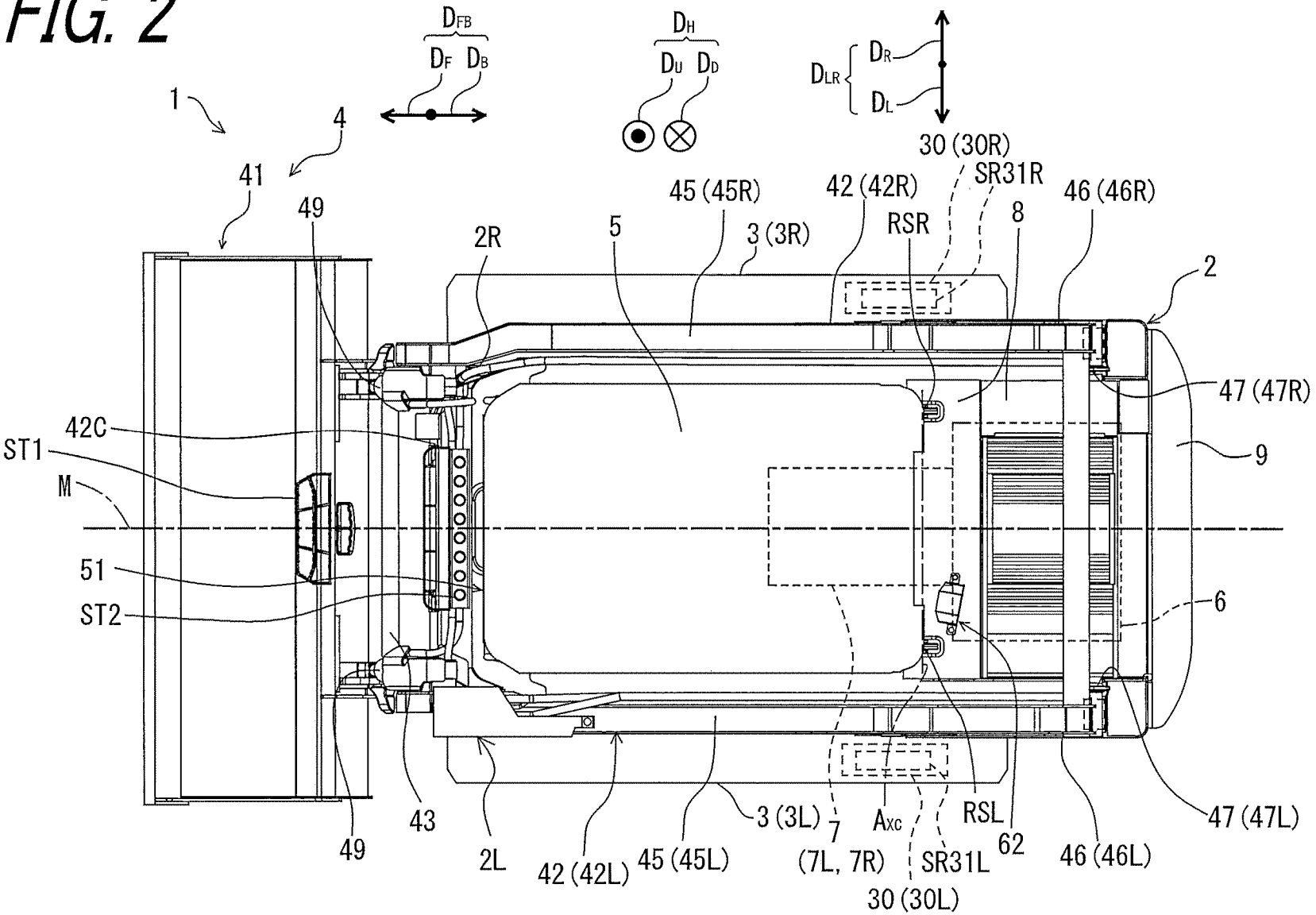
FIG. 2 is a top view of the work vehicle.

Referring to FIGS. 1 and 2, a work vehicle 1, for example, a compact truck loader, includes a vehicle body 2, a pair of traveling devices 3, and a work device 4. The vehicle body 2 supports the traveling device 3 and the work device 4. In the illustrated embodiment, the traveling device 3 is a crawler type traveling device provided on the vehicle body 2. Therefore, each of the pair of traveling devices 3 includes a drive wheel 31, driven wheels 32 and 33, and a rolling wheel 34, which are driven by the hydraulic motor device 30. However, each of the pair of traveling devices 3 is not limited to the crawler type traveling device 3. Each of the pair of traveling devices 3 may be, for example, a front wheel/rear wheel traveling device 3 or a traveling device 3 having a front wheel and a rear crawler. The work device 4 comprises work equipment (bucket) 41 at the distal end of the work device 4. A proximal end of the work device 4 is attached to a rear portion of the vehicle body 2. The work device 4 includes a pair of arm assemblies 42 for rotatably supporting the bucket 41 via a bucket pivot shaft 43. Each of the pair of arm assemblies 42 includes a link 44 and an arm 45.

The link 44 is rotatable relative to the vehicle body 2 about the fulcrum shaft 46. The arm 45 is rotatable relative to the link 44 about the joint shaft 47. The work device 4 further includes a plurality of arm cylinders 48 and at least one equipment cylinder 49. Each of the plurality of arm cylinders 48 is rotatably connected to the vehicle body 2 and the arm 45, and moves the link 44, the arm 45, and the like to raise and lower the bucket 41. The at least one implement cylinder 49 is configured to tilt the bucket 41. The vehicle body 2 includes a cabin 5. The cabin 5 includes a front window 51 that can be opened and closed, and the outer shape of the cabin 5 is defined by a cab frame 53. The front window 51 may be omitted. The work vehicle 1 includes a driver's seat 54 and an operation lever 55 in the cabin 5. As shown in FIG. 2, the cab frame 53 is rotatable around rotational shafts RSL and RSR on the vehicle body 2. FIGS. 1 and 2 illustrate the common pivot AXC defined by the rotational shafts RSL and RSR. That is, the cab frame 53 is attached to the vehicle body 2 so as to be rotatable around the pivot AXC.

In the embodiment according to the present application, a front-back direction $D_{FB}$ (forward direction $D_F$/backward direction $D_B$) means a front-back direction (forward direction/backward direction) as seen from an operator seated on the driver's seat 54 of the cabin 5. A leftward direction $D_L$, a rightward direction $D_R$, a width direction $D_W$ means the left direction, the right direction, and the left-right direction as viewed from the operator, respectively. An upward direction $D_U$, a downward direction $D_D$, height direction $D_H$ means an upward direction, a downward direction, and a height direction as viewed from the operator. The front-back, left-right (width), and up-down (height) directions of the work vehicle 1 coincide with the front-back, left-right (width), and up-down (height) directions as viewed from the operator, respectively.

FIG. 1 shows the left side of the work vehicle 1. As shown in FIG. 2, the vehicle body 2 is substantially plane-symmetric with respect to the vehicle body center surface M, and is a first side surface 2L which is a left side surface and a second side surface 2R which is a right side face. Among the pair of traveling devices 3, the traveling device 3 provided on the first side surface 2L is shown as the left traveling device 3L, and the traveling device 3 provided on the second side surface 2R is shown as the right traveling device 3R. Among the pair of arm assemblies 42, the arm assembly 42 provided on the left side with respect to the vehicle body center surface M is shown as the first arm assembly 42L, and the arm assembly 42 provided on the right side with respect to the vehicle body center surface M is shown as the second arm assembly 42R. The link 44 provided on the left side of the vehicle body center surface M is shown as a first link 44L. An arm 45 provided on the left side of the vehicle body center surface M is shown as a first arm 45L, and an arm 45 provided on the right side of the vehicle body center surface M is shown as a second arm 45R. The fulcrum shaft 46 provided on the left side of the vehicle body center surface M is shown as the first fulcrum shaft 46L. The fulcrum shaft 46 provided on the right side with respect to the vehicle body center surface M is shown as a second fulcrum shaft 46R. The joint shaft 47 provided on the left side with respect to the vehicle body center surface M is shown as a first joint shaft 47L, and the joint shaft 47 provided on the right side with respect to the vehicle body center surface M is shown as a second joint shaft 47R. Among the hydraulic motor device 30, the hydraulic motor device 30 provided on the left side with respect to the vehicle body center surface M is shown as the left hydraulic motor device 30L. The hydraulic motor device 30 provided on the right side with respect to the vehicle body center surface M is shown as a right hydraulic motor device 30R.

Referring to FIGS. 1 and 2, the work vehicle 1 includes an engine 6 (an example of a prime mover) provided at a rear portion of a vehicle body 2, and a plurality of hydraulic pumps including the left hydraulic pump 7L and the right hydraulic pump 7R. The engine 6 drives a plurality of hydraulic pumps 7. The left and right hydraulic pumps 7L and 7R are configured to discharge hydraulic fluid for driving a hydraulic motor device 30 and the like that drive the drive wheel 31. The left hydraulic pump 7L and the right hydraulic pump 7R are collectively referred to as hydraulic pumps (7L, 7R). The plurality of hydraulic pumps 7 other than the left hydraulic pumps 7L and the right hydraulic pumps 7R is configured to discharge hydraulic fluid for driving hydraulic actuators (a plurality of arm cylinders 48, at least one instrument cylinder 49, and the like) connected to the work device 4. The engine 6 is provided between the pair of arm assemblies 42 in the width direction $D_W$ of the work vehicle 1. The work vehicle 1 further includes a cover 8 for covering the engine 6. The work vehicle 1 further includes a bonnet cover 9 provided at the rear end of the vehicle body 2. The bonnet cover 9 is openable and closable such that a maintenance worker can perform maintenance work of the engine 6 and the like.

Figure 3:
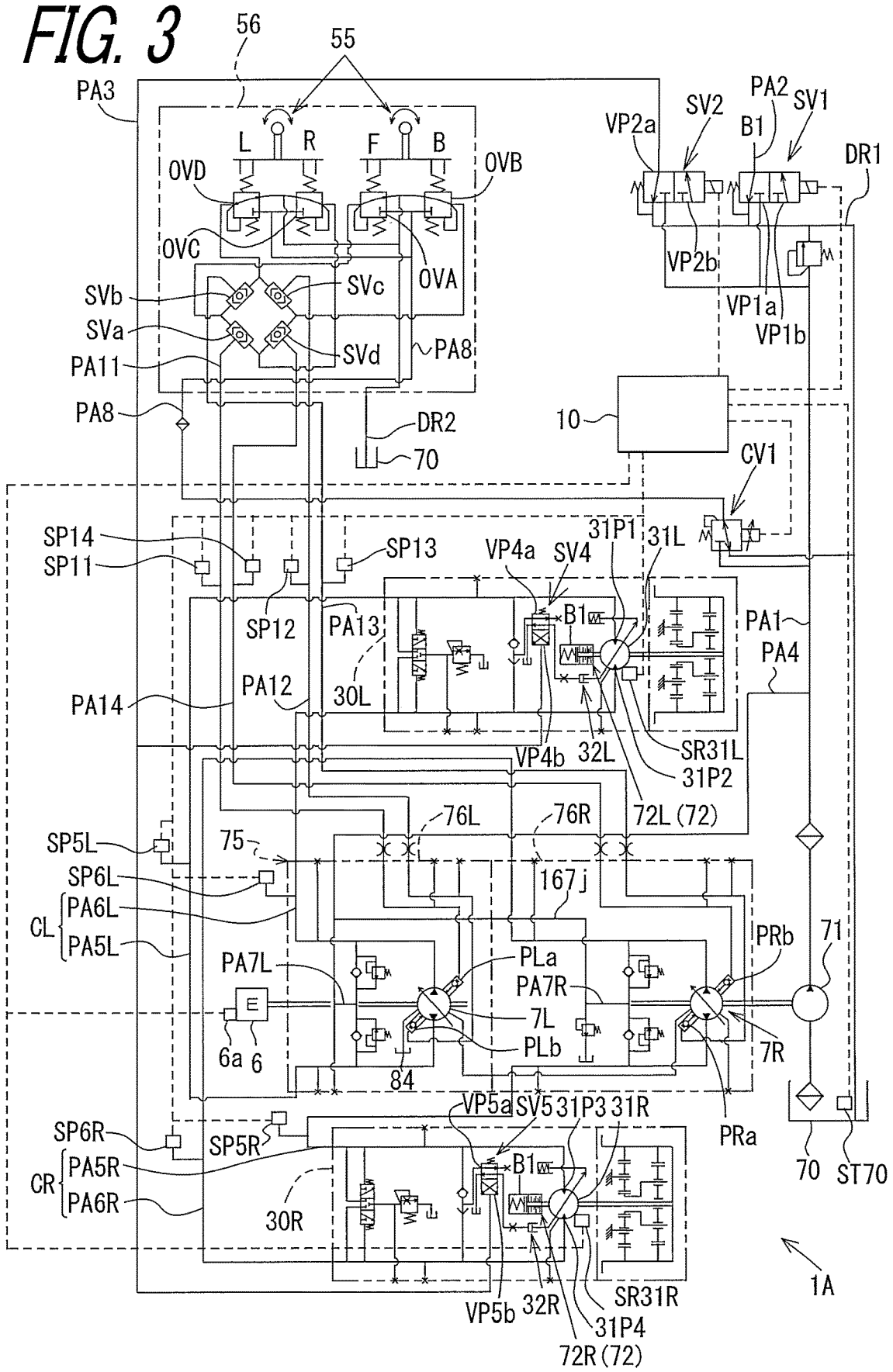
FIG. 3 is a hydraulic circuit diagram of a travel system of the work vehicle in the first embodiment.

FIG. 3 is a hydraulic circuit diagram of the travel system of the work vehicle 1 in the first embodiment. The work vehicle 1 includes a hydraulic circuit 1A. The hydraulic circuit 1A includes a hydraulic fluid tank 70 and a pilot pump 71. The pilot pump 71 is a gear pump of a constant displacement type driven by the power of the engine 6. The pilot pump 71 is configured to discharge the hydraulic oil stored in the hydraulic fluid tank 70. In particular, the pilot pump 71 is configured to discharge the hydraulic oil mainly used for control. For convenience of description, the hydraulic oil used for control among the hydraulic oil discharged from the pilot pump 71 is referred to as pilot oil, and the pressure of the pilot oil is referred to as pilot pressure. In particular, the pilot pump 71 is configured to supply pilot oil to the left hydraulic pumps 7L and the right hydraulic pump 7R.

The hydraulic circuit 1A includes The hydraulic circuit includes a pilot oil supply passage PA1 connected to a discharge port of the pilot pump 71. The pilot oil is supplied to the pilot supply oil passage PA1. The hydraulic circuit 1A includes a plurality of switching valves (brake switching valves, direction switching valve SV2) connected to the pilot oil supply passage PA1, and a plurality of brake mechanisms 72. The brake switching valve SV1 is connected to the pilot oil supply passage PAL. The brake switching valves SV1 are direction switching valves (electromagnetic valves) for performing braking and releasing the braking by the plurality of brake mechanisms 72. The brake switching valve SV1 is a two-position switching valve configured to switch a valve element to the first position VP1*a* and the second position VP1*b* by exciting. Switching of the valve element of the brake switching valve SV1 is performed by the brake pedal 13 (see FIG. 6). The brake pedal 13 is provided with a sensor 14. The operation amount detected by the sensor 14 is input to a controller 10 including an electric control unit (ECU). The controller 10 may be referred to as a control device.

The plurality of brake mechanisms 72 include a first brake mechanism 72L for braking the left traveling device 3L and a second brake mechanism 72R for braking the right traveling device 3R. The first brake mechanism 72L and the second brake mechanism 72R are connected to the brake switching valves via the oil passage PA2. The first brake mechanism 72L and the second brake mechanism 72R are configured to brake the traveling device 3 in accordance with pressures of pilot oil (hydraulic fluid). When the valve element of the brake switching value SV1 is switched to the first position VP1*a*, the hydraulic fluid is discharged from the oil passage PA2 in a section between the brake switching value SV1 and the brake mechanism 72, and the traveling device 3 is braked by the brake mechanism 72. When the valve element of the brake switching value SV1 is switched to the second position VP1*b*, the braking by the brake mechanism 72 is released. Note that the braking by the brake mechanism 72 may be released when the valve element of the brake switching valves SV1 is switched to the first position VP1*a*, and the traveling device 3 may be braked by the brake mechanism 72 when the valve element of the brake switching valves SV1 is switched to the second position VP1*b*.

Direction switching valve SV2 is a solenoid valves for changing the rotation of the left hydraulic motor device 30L and the right hydraulic motor device 30R. The direction switching valve SV2 is a two-position switching valve configured to switch a valve element to the first position VP2*a* or second position VP2*b* by excitation. The direction switching valve SV2 is switched by a human-machine interface (not illustrated) or the like. The human-machine interface includes, for example, a lever, a switch, a button, a dial, a pedal, or a button shown on a touch panel. The direction switching valve SV2 may be a proportional control valve capable of adjusting the flow rate of the hydraulic fluid to be discharged, instead of a two-position control valve.

The left hydraulic motor device 30L is a device configured to generate a driving force of the work vehicle to transmit power to the drive wheel 31 provided in the left traveling device 3L. The left hydraulic motor device 30L includes a left hydraulic motor 31L, a first swash plate switching cylinder 32L, and a first travel control valve (hydraulic switching value) SV4. The left hydraulic motor 31L is a swash plate type variable capacity axial motor for driving the left traveling device 3L, and is a motor capable of changing the vehicle speed (rotation) to the first speed or the second speed. The first swash plate switching cylinder 32L is a cylinder configured to change the angle of the swash plate of the left hydraulic motor 31L by extension and contraction. The first travel control valve SV4 is used to extend and contract the first swash plate switching cylinder 32L. The first travel control valve SV4 is a two-position switching valve configured to switch its valve element between a first position VP4*a* and a second position VP4*b*.

Switching of the first travel control valve SV4 is performed by a directional switching valve SV2 located on the upstream side and connected to the first travel control valve SV4. Specifically, the direction switching valve SV2 and the first travel control valve SV4 are connected by an oil passage PA3, and switching operation of the first travel control valve SV4 is performed by hydraulic fluid flowing through the oil passage PA3. For example, the valve element of the direction switching valve SV2 is switched to the first position VP2*a*, the pilot oil is released in the section between the direction switching valve SV2 and the first travel control valve SV4, and the valve element of the first travel control valve SV4 is switched to the first position VP4*a*. As a result, the first swash plate switching cylinder 32L contracts, and the speed of the left hydraulic motor 31L is changed to the first speed. When the valve element of the direction switching valve SV2 is switched to the second position VP2*b* by the operation of the human-machine interface, the pilot oil is supplied to the first travel control valve SV4 through the direction switching valve SV2, and the valve element of the first travel control valve SV4 is switched to the second position VP4*b*. As a result, the first swash plate switching cylinder 32L is extended, and the speed of the left hydraulic motor 31L is changed to the second speed.

The right hydraulic motor device 30R is a device configured to generate a driving force of the work vehicle to transmit power to the drive wheel 31 provided in the right traveling device 3R. The right hydraulic motor device 30R includes a right hydraulic motor 31R, a second swash plate switching cylinder 32R, and a second travel control valve (hydraulic switching value) SV5. The right hydraulic motor device 30R is a hydraulic motor configured to drive the right traveling device 3R, and operates in the same manner as the left hydraulic motor 31L. That is, the right hydraulic motor 31R operates in the same manner as the left hydraulic motor 31L. The left hydraulic motor 31L and the right hydraulic motor 31R are collectively referred to as hydraulic motors (31L, 31R). The second swash plate switching cylinder 32R operates in the same manner as the first swash plate switching cylinder 32L. The second travel control valve SV5 is a two-position switching valve configured to switch its valve element between the first position VP5*a* and the second position VP5*b*, and operates in the same manner as the first travel control valve SV4.

The hydraulic circuit 1A is connected to a drain oil passage DR1. The drain oil passage DR1 is an oil passage to make the pilot oil flow from a plurality of switching valves (brake switching valves SV1 and a direction switching valves SV2) to the hydraulic fluid tank 70. For example, the drain oil passage DR1 is connected to discharge ports of a plurality of switching valves (brake switching valves SV1 and direction switching valves SV2). That is, when the brake switching valve SV1 is at the first position VP1*a*, the hydraulic fluid is discharged from the oil passage PA2 to the drain oil passage DR1 in the interval between the brake switching valve SV1 and the brake mechanism 72. When the direction switching valve SV2 is at the first position VP1*a*, the pilot oil in the oil passage PA3 is discharged to the drain oil passage DR1.

The hydraulic circuit 1A further includes a first charge oil passage PA4 and a hydraulic drive device 75. The first charge oil passage PA4 is branched from the pilot oil supply passage PA1 and connected to the hydraulic drive device 75. The hydraulic drive device 75 is a device that drives the left hydraulic motor device 30L and the right hydraulic motor device 30R. The hydraulic drive device 75 includes a first drive circuit 76L for driving the left hydraulic motor device 30L and a second drive circuit 76R for driving the right hydraulic motor device 30R.

The first drive circuit 76L includes a left hydraulic pump 7L, a driving oil passage PA5L, PA6L, and a second charge oil passage PA7L. The driving oil passages PA5L and PA6L are oil passages that connect the left hydraulic pump 7L and the left hydraulic motor 31L. The hydraulic circuit formed by the driving oil passages PA5L and PA6L is referred to as a left hydraulic circuit CL. The second charge oil passage PA7L is an oil passage that is connected to the driving oil passages PA5L and PA6L and replenishes the driving oil passages PA5L and PA6L with the hydraulic fluid from the pilot pump 71. The left hydraulic motor 31L has a first connection port 31P1 connected to the driving oil passage PA5L and a second connection port 31P2 connected to the driving oil passage PA6L. The hydraulic fluid for rotating the left traveling device 3L in the forward direction is input to the left hydraulic motor 31L via the first connection port 31P1, and the hydraulic fluid for rotating the left traveling device 3L in the backward direction is discharged from the left hydraulic motor 31L via the first connection port 31P1. The hydraulic fluid for rotating the left traveling device 3L in the backward direction is input to the left hydraulic motor 31L via the second connection port 31P2, and the hydraulic fluid for rotating the left traveling device 3L in the forward direction is discharged from the left traveling device 3L.

Similarly, the second drive circuit 76R includes a right hydraulic pump 7R, driving oil passages PA5R and PA6R, and a third charge oil passage PA7R. The driving oil passages PA5R and PA6R are oil passages that connect the right hydraulic pump 7R and the right hydraulic motor 31R. The hydraulic circuit formed by the driving oil passages PA5R and PA6R is referred to as a right hydraulic circuit CR. The third charge oil passage PA7R is an oil passage that is connected to the driving oil passages PA5R and PA6R and replenishes the driving oil passages PA5R and PA6R with the hydraulic fluid from the pilot pump 71. The right hydraulic motor 31R includes a third connection port 31P3 connected to the driving oil passage PA5R, and a fourth connection port 31P4 connected to the driving oil passage PA6R. The hydraulic fluid for rotating the right traveling device 3R in the forward direction is input to the right hydraulic motor 31R via the third connection port 31P3, and the hydraulic fluid for rotating the right traveling device 3R in the backward direction is discharged from the right hydraulic motor 31R via the third connection port 31P3. The hydraulic fluid for rotating the right traveling device 3R in the backward direction is input to the right hydraulic motor 31R via the fourth connection port 31P4, and the hydraulic fluid for rotating the right traveling device 3R in the forward direction is discharged from the right traveling device 3R. That is, the hydraulic motor (31L, 31R) is configured to drive the traveling device (3L, 3R). The hydraulic pumps (7L, 7R) are configured to discharge hydraulic fluid for driving the hydraulic motors (31L, 31R). The driving oil passages (PA5L, PA6L, PA5R, PA6R) are oil passages that connect the hydraulic pumps (7L, 7R) and the hydraulic motors (31L, 31R).

The left hydraulic pump 7L and a right hydraulic pump 7R are a swash plate type variable capacity axial pump which is driven by the power of the engine 6. The left hydraulic pump 7L which is connected to a left hydraulic motor 31L via a left hydraulic circuit CL includes a first port Pla and a second port PLb to which pilot pressure acts. The angle of the swash plate in the left hydraulic pump 7L is changed by the pilot pressure acting on the first port PLa and the second port PLb. Specifically, the left hydraulic pump 7L is configured to supply hydraulic fluid to a left hydraulic motor 31L via a left hydraulic circuit CL so as to drive a left traveling device 3L forward when the hydraulic pressure applied to a first port PLa is higher than the hydraulic pressure applied to a second port PLb, and to supply hydraulic fluid to the left hydraulic motor 31L via a left hydraulic circuit CL so as to drive the left traveling device 3L backward when the hydraulic pressure applied to a second port PLb is higher than the hydraulic pressure applied to a first port PLa.

The right hydraulic pump 7R is connected to the right hydraulic motor 31R via the right hydraulic circuit CR, and has a third port PRa and a fourth port PRb on which the pilot pressure acts. The right hydraulic pump 7R is configured such that the angle of the swash plate is changed by the pilot pressure acting on the third port PRa and the fourth port PRb, and supply hydraulic fluid to the right hydraulic motor 31R. To be more specific, the right hydraulic pump 7R is configured to supply the hydraulic fluid to the right hydraulic motor 31R via the right hydraulic circuit CR so as to drive the right traveling device 3R forward when the hydraulic pressure applied to the third port PRa is higher than the hydraulic pressure applied to the fourth port PRb, and to supply the hydraulic fluid to the right hydraulic motor 31R via the right hydraulic circuit CR so as to drive the right traveling device 3R backward when the hydraulic pressure applied to the fourth port PRb is higher than the hydraulic pressure applied to the third port PRa. The left hydraulic pump 7L and the right hydraulic pump 7R can change outputs (discharge amounts of the hydraulic fluid) and discharge directions of the hydraulic fluid in accordance with the angle of the swash plate.

The outputs of the left and right hydraulic pumps 7L and 7R and the discharge direction of the hydraulic fluid are changed by the operation device 56 for operating the traveling direction of the work vehicle 1. To be specific, the outputs of the left and right hydraulic pumps 7L and 7R and the discharge direction of the hydraulic fluid are changed in accordance with the operation of the operation lever 55 included in the operation device 56. That is, the operation device 56 is a device configured to select at least one of the left traveling device 3L and the right traveling device 3R and instruct at least one of the traveling devices to move forward or backward, thereby operating the traveling direction of the work vehicle. The user inputs an instruction of the traveling direction via the operation lever 55. The operation lever 55 may be referred to as an additional human-machine interface. A position of the operation lever 55 is, for example, an indicated position of the additional human-machine interface.

As shown in FIG. 3, the hydraulic circuit 1A is branched from the pilot oil supply passage PA1 and includes a pilot oil supply passage PA8 connected to the operation device 56 and a primary pressure control valve CV1 provided on the pilot oil supply passage PA8. In the following embodiments, the pilot oil supply passage PA1 and the pilot oil supply passage PA8 are collectively referred to as a primary pilot oil passage. The primary pressure control valve CV1 is a solenoid proportional control valve (control mechanism, hydraulic control circuit) including a solenoid, and is configured to adjust the pilot pressure supplied to the operation device 56 by adjusting the opening degree in accordance with the current applied to the solenoid. The opening degree of the primary pressure control valve CV1 is controlled by a current sent from the controller 10. That is, the controller 10 is configured to control the primary pressure control valve CV1. Note that, as the magnitude of the current increases, the pilot pressure output from the primary pressure control valve CV1 may also increase, and as the magnitude of the current increases, the pilot pressure output from the primary pressure control valve CV1 may also decrease. In the following embodiments, the primary pressure control valve CV1 may be referred to as a hydraulic adjustment mechanism. The detailed operation of the primary pressure control valve CV1 will be described later.

The operation device 56 includes an operation valve OVA for forward movement, an operation valve OVB for backward movement, an operation valve OVC for right turning, an operation valve OVD for left turning, and an operation lever 55. The operation device 56 includes first to fourth shuttle valves SVa, SVb, SVc, and SVd. The operation valves OVA, OVB, OVC, and OVD are operated by one operation lever 55. The operation valves OVA, OVB, OVC, and OVD change the pressure of the hydraulic oil in accordance with the operation of the operation lever 55, and supply the changed hydraulic fluid to the first port PLa and the second port PLb of the left hydraulic pump 7L and the third port PRa and the fourth port PRb of the right hydraulic pump 7R. In this embodiment, the operation valves OVA, OVB, OVC, and OVD are operated by one operation lever 55, but the number of operation levers 55 may be plural.

The operation valves OVA, OVB, OVC, and OVD each have an input port (primary port), a discharge port, and an output port (secondary port). As shown in FIG. 3, the input port is connected to the pilot oil supply passage PA8. The discharge port is connected to the drain oil passage DR2 which leads to the hydraulic fluid tank 70. The operation lever 55 can be tilted from a neutral position in the longitudinal direction, in the width direction orthogonal to the longitudinal direction, and in the oblique direction. The neutral position is located when the operation lever 55 is not operated. The neutral position of the operation lever 55 may be referred to as a return position. That is, the return position is a position to which the indicated position of human-machine interface is returned located when the human-machine interface is not the operated. The operation valves OVA, OVB, OVC, and OVD of the operation device 56 is operated according to the tilting of the operation lever 55. Thus, the pilot pressure corresponding to the operation amount of the operation lever 55 from the neutral position is output from the secondary side ports of the operation valves OVA, OVB, OVC, and OVD. The relationship between the pilot pressure applied to the primary port and the pilot pressure applied to the secondary port, which are output from the primary pressure control valve CV1, will be described later.

The secondary ports of the operation valves OVA and OVC are connected to the input ports of the first shuttle valves SVa, and the output ports of the first shuttle valve SVa are connected to the first port PLa of the left hydraulic pump 7L via the first pilot oil passage PA11. The secondary ports of the operation valves OVA and OVD are connected to the inlet ports of the second shuttle valves SVb, and the outlet ports of the second shuttle valves SVb are connected to the third ports PRa of the right hydraulic pumps 7R via the third pilot oil passages PA13. The secondary ports of the operation valves OVB and OVD are connected to the inlet port of the third shuttle valve SVc, and the outlet port of the third shuttle valve SVc are connected to the second port PLb of the left hydraulic pump 7L via the second pilot oil passage PA12. The secondary ports of the operation valves OVB and OVC are connected to the inlet port of the fourth shuttle SVd, and the outlet port of the fourth shuttle SVd is connected to the fourth port PRb of the right hydraulic pump 7R via the fourth pilot passage PA14. That is, the pilot oil supply passage PA8, the first pilot oil passage PA11, and the fourth pilot oil passage PA14 connect the pilot pump 71 and the left hydraulic pump 7L. The pilot oil supply passage PA8, the second pilot oil passage PA12, and the third pilot oil passage PA13 connect the pilot pump 71 and the right hydraulic pump 7R.

When the operation lever 55 is tilted forward, the operation valve OVA for forward movement is operated, and a pilot pressure is output from the operation valve OVA. This pilot pressure acts on the first port PLa from the first shuttle valve SVa via the first pilot oil passage PA11 connecting the operation device 56 and the first port PLa of the left hydraulic pump 7L, and acts on the third port PRa via the third pilot oil passage PA13 connecting the operation device 56 and the third port PRa of the right hydraulic pump 7R from the second shuttle valve SVb. As a result, the output shafts of the left and right hydraulic pumps 7L and 7R rotate in the normal direction (forward direction) at a speed corresponding to the amount of tilt of the operation lever 55, and the work vehicle 1 moves straight forward.

Further, the operation lever 55 is tilted backward, the operation valve for backward movement is operated, and the pilot pressure is output from the operation valve OVB. The pilot pressure acts on the second port PLb of the left hydraulic pump 7L from the third shuttle valve SVc via the second pilot oil passage PA12 connecting the operation device 56 and the second port, and acts on the fourth port PRb from the fourth shuttle SVd via the fourth pilot oil passage PA14 connecting the operation device 56 and the fourth port PRb of the right hydraulic pump 7R. As a result, the output shafts of the left and right hydraulic pumps 7L and 7R are reversed (backward rotation) at a speed corresponding to the amount of tilt of the operation lever 55, so that the work vehicle 1 travels straight backward.

When the operation lever 55 is tilted to the right side, the operation valve OVC for right turning is operated, and the pilot pressure is output from the operation valve OVC. This pilot pressure acts on the first port PLa of the left hydraulic pump 7L from the first shuttle valve SVa via the first pilot oil passage PA11, and acts on the fourth port PRb of the right hydraulic pump 7R from the fourth shuttle valve SBd via the fourth pilot oil passage PA14. Thereby the vehicle curves to the right with a degree of curvature corresponding to the operation position in the right direction of the operation lever 55.

When the operation lever 55 is tilted to the left side, the operation valve OVD for left turning is operated, and the pilot pressure is output from the operation valve OVD. This pilot pressure acts on the third port PRa of the right hydraulic pump 7R from the second shuttle valves SVb via the third pilot oil passage PA13, and also acts on the second port PLb of the left hydraulic pump 7L from the third shuttle valve SVc via the second pilot oil passage PA12. Thus, the vehicle turns leftward with a degree of bending corresponding to the leftward operation position of the operation lever 55.

That is, when the operation lever 55 is tilted obliquely forward to the left, the work vehicle 1 moves forward at a speed corresponding to the operation position of the operation lever 55 in the front-rear direction, and curves to the left in a manner corresponding to the operation position of the operation lever 55 in the left direction. When the operation lever 55 is tilted obliquely forward to the right, the work vehicle 1 turns to the right while moving forward at a speed corresponding to the operation position of the operation lever 55. When the operation lever 55 is operated to tilt obliquely rearward to the left, the work vehicle 1 turns to the left while moving rearward at a speed corresponding to the operation position of the operation lever 55. When the operation lever 55 is tilted obliquely rearward to the right, the work vehicle 1 turns to the right while moving backward at a speed corresponding to the operation position of the operation lever 55.

Next, the detailed operation of the primary pressure control valve CV1 will be described. The work vehicle 1 includes a setting member 11 (see FIG. 6) for setting a target rotation speed of the engine 6. The setting member 11 is an accelerator pedal which is a speed input device different from the operation device 56 described above or an accelerator lever which is supported so as to be swingable or a rotatable indoor dial. The setting member 11 is provided with a sensor 12. The operation amount detected by the sensor 12 is input to the controller 10 (an example of operation detection circuitry). The engine rotation speed corresponding to the setting member 11 is the target rotation speed of the engine 6. In other words, the target rotation speed of the engine 6 is set based on the operation amount of the setting member 11. The controller 10 outputs a rotation command indicating, for example, a fuel injection amount, an injection timing, and a fuel injection rate to the injector so that the determined target rotation speed of the engine 6 is achieved. Alternatively, the controller 10 outputs a rotation command indicating a fuel injection pressure or the like to the supply pump or the common rail so that the determined target rotation speed of the engine 6 is achieved.

In the following embodiments, the one or more operation levers 55 and the setting member 11 may be referred to as at least one operation device. A speed sensor 6*a* for detecting an actual engine rotation speed (referred to as an actual rotation speed of the engine 6) is connected to the controller 10, and the actual rotation speed of the engine 6 is input to the controller 10. The speed sensor 6*a* is, for example, a potentiometer configured to detect the rotation speed of a rotary member connected to the crankshaft of the engine 6. When a load is applied to the engine 6, the actual rotational speed of the engine 6 decreases from the target rotational speed of the engine 6. The amount of decrease in the actual rotational speed from the target rotation speed (the difference between the target rotation speed of the engine and the actual rotational speed of the engine) when a load is applied to the engine 29 is referred to as the amount of drop of the engine.

Figure 4:
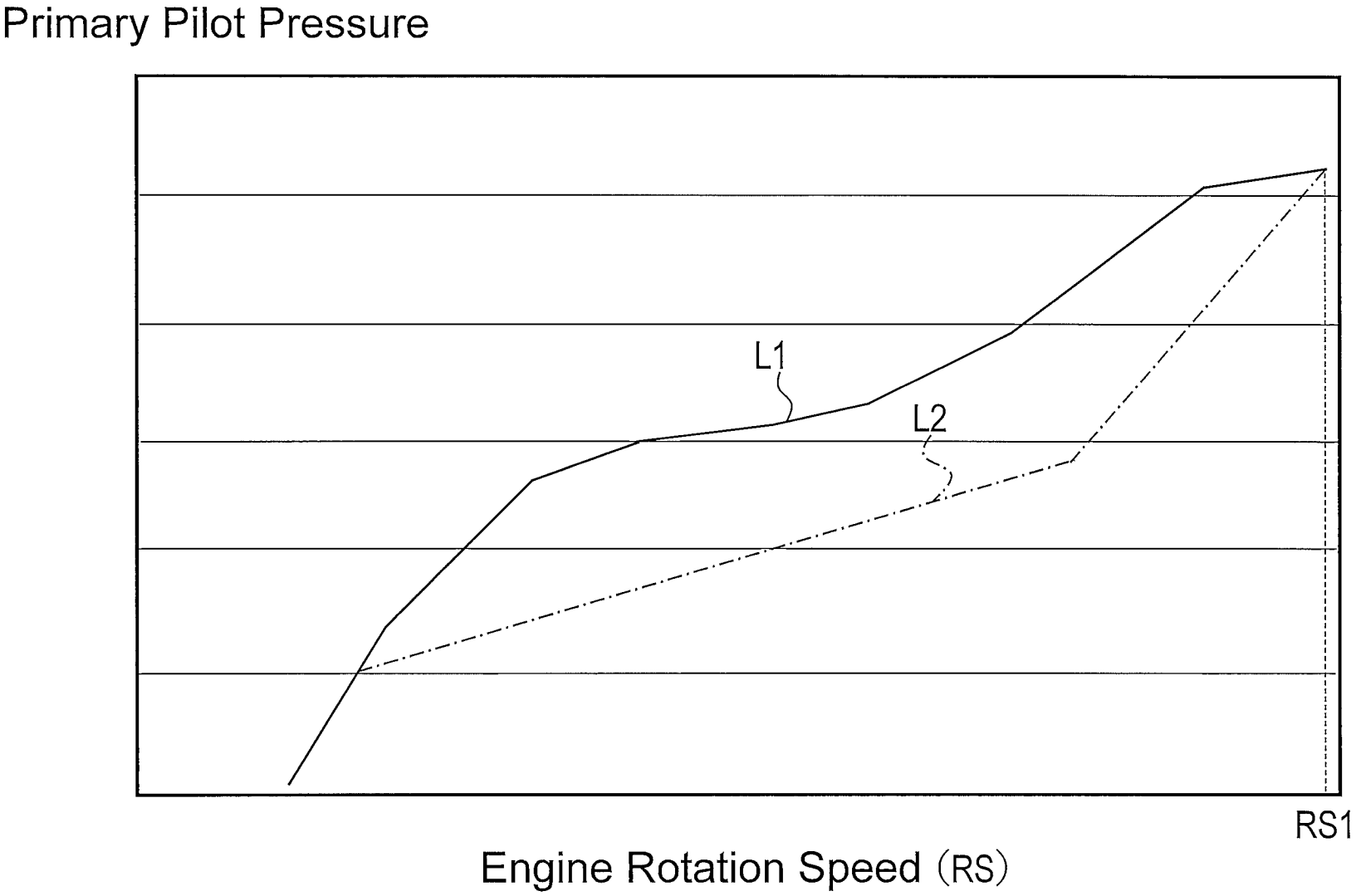
FIG. 4 is a diagram showing a relationship between an engine speed, a primary pilot pressure, and a setting line.

The primary pressure control valve CV1 can set the a pilot pressure (primary pilot pressure) that acts on the input ports (primary-side ports) of the plurality of operation valves OVA, OVB, OVC, and OVD based on a decrease amount (drop amount) ΔE1 of the rotation speed of the engine 6 (engine rotation speed E1). That is, the primary pressure control valve CV1 is a control valve that is provided between the pilot pump 71 and the operation valves OVA, OVB, OVC, and OVD, and is configured to send the pilot oil to the operation valves OVA, OVB, OVC, and OVD and convert the pressures of the pilot oil supplied to the operation valves OVA, OVB, OVC, and OVD into the primary pilot pressures. The rotation speed of the engine 6 can be detected by a speed sensor 6*a* of the engine rotation speed E1. The engine rotation speed E1 detected by the speed sensor 6*a* is input to the controller 10. The speed sensor 6*a* may be referred to as a speed sensor. FIG. 4 shows the relationship between the engine rotation speed, the traveling primary pressure (primary pilot pressure), and the setting lines L1 and L2. The setting line L1 indicates the relationship between the engine rotation speed E1 and the primary pilot pressure when the amount of decrease ΔE1 is less than a predetermined value (less than the anti-stall determination value). The setting line L2 indicates the relationship between the engine rotation speed E1 and the primary pilot pressure when the amount of decrease ΔE1 is equal to or greater than the anti-stall determination value. When the difference between the rotation speed RS determined based on the operation amount of the setting member 11 and the actual rotation speed of the engine 6 is smaller than a predetermined stall determination speed difference (anti-stall determination value), the primary pilot pressure corresponding to the rotation speed RS transitions in accordance with the third correspondence relationship indicated by the setting line L1. When the difference between the rotation speed RS and the actual rotation speed of the engine 6 is equal to or larger than a predetermined stall determination speed difference (anti-stall determination value), the primary pilot pressure corresponding to the rotation speed RS transitions in accordance with the fourth correspondence relationship indicated by the setting line L2.

When the amount of decrease ΔE1 is less than the anti-stall determination value, the controller 10 adjusts the opening degree of the primary pressure control valve CV1 so that the relationship between the engine rotation speed E1 and the primary pilot pressure matches the reference pilot pressure indicated by the setting line L1. Further, when the amount of decrease ΔE1 is equal to or greater than the anti-stall determination value, the controller 10 adjusts the opening degree of the primary pressure control valve CV1 so that the relationship between the engine rotation speed E1 and the primary pilot pressure matches the setting line L2 lower than the reference pilot pressure. In the setting line L2, the primary pilot pressure for a predetermined engine rotation speed E1 is lower than the primary pilot pressure of the setting line L1. That is, when focusing on the same engine rotation speed E1, the primary pilot pressure of the setting line L2 is set to be lower than the primary pilot pressure of the setting line L1. Therefore, the pressures (pilot pressures) of the hydraulic fluids entering the operation valves OVA, OVB, OVC, and OVD are suppressed to be low by the control based on the setting line L2. As a result, the angles of the swash plates of the left and right hydraulic pumps 7L and 7R are adjusted, and the load acting on the engine 6 is reduced, thereby preventing the engine 6 from stalling. Although one setting line L2 is shown in FIG. 4, a plurality of setting lines L2 may be provided. For example, the setting line L1 may be set for each engine rotation speed L2. Data or the control parameter such as the function indicating the setting line L1 and L2 is preferably included in the controller 10.

Figure 5:
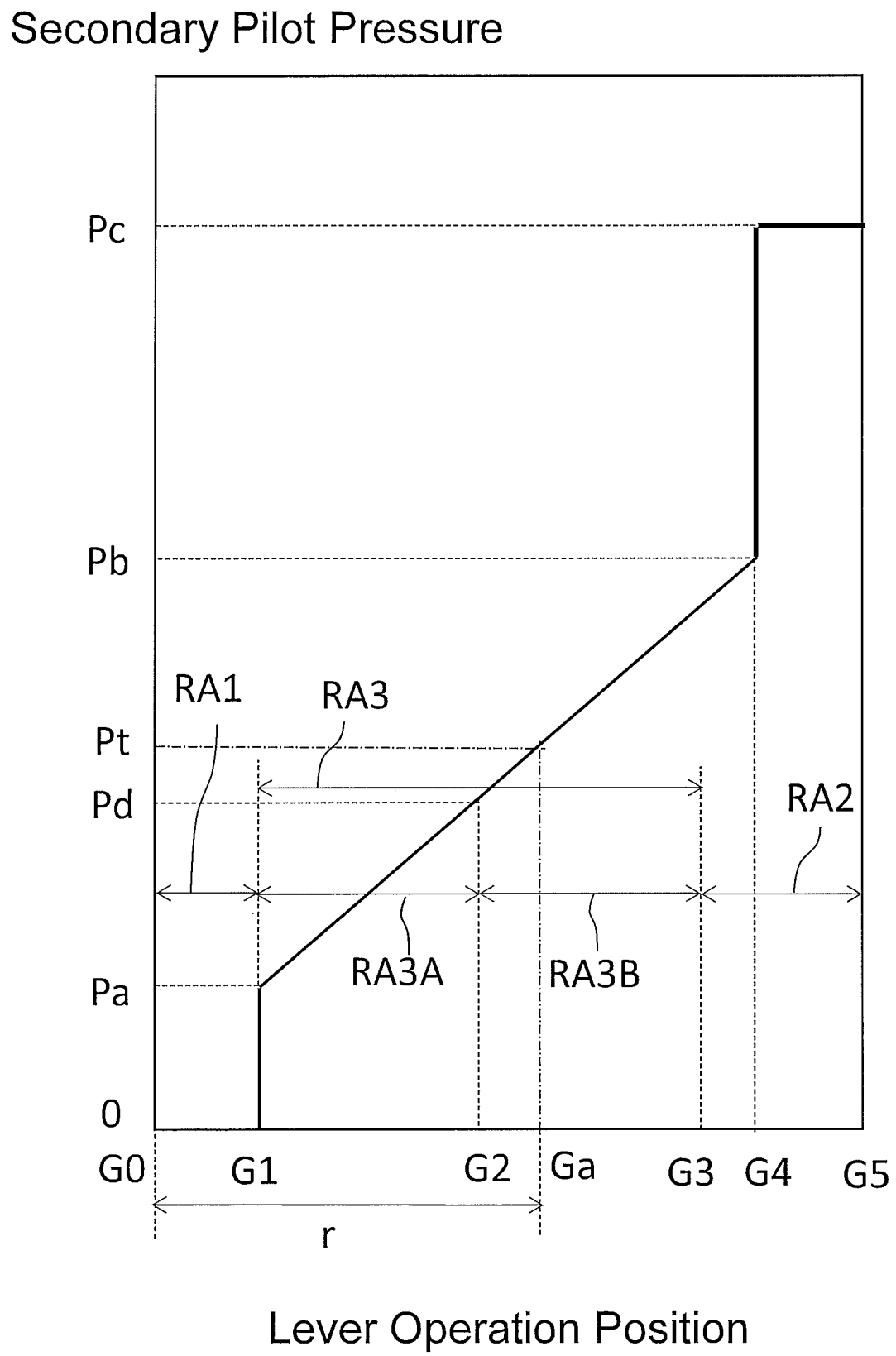
FIG. 5 is a diagram showing a relationship between the operation position of the operation lever and the secondary pilot pressure.

Next, the pilot pressure (secondary pilot pressure) output from the secondary port of the operation valves OVA, OVB, OVC, and OVD will be described. FIG. 5 is a diagram showing a relationship between the operation position of the operation lever and the secondary pilot pressure. Referring to FIG. 4, the origin of the lever operation position is an operation start position (neutral position, G0 position) which is a start position of the lever stroke, and the lever operation position approaches an operation end position (G5 position) which is an end position of the lever stroke as the lever operation position is away from the origin. The operation region of the operation lever 55 is divided into a neutral region RA1 (from the G0 position to the G1 position in the illustrated example) where the operation target does not move, a full operation vicinity region RA2 (from the G3 position to the G5 position in the illustrated example) near the operation end, and an intermediate region RA3 (from the G1 position to the G3 position in the illustrated example) between the neutral region RA1 and the full operation vicinity region RA2. Further, the intermediate region RA3 is divided into a very low speed region RA3A from the G1 position to the G2 position and an intermediate speed region RA3B from the G2 position to the G3 position.

In the neutral region RA1, the secondary pilot pressure is not supplied even if the operation lever 55 is operated. On the other hand, in the full operation vicinity region RA2, the speed of the operation target is not adjusted, and therefore, the operation lever 55 is operated to the operation terminal position (G5 position) without stopping in the middle. In the intermediate region RA3, the speed of the operation target is adjusted to a speed desired by the operator by stopping the operation lever 55 at an arbitrary position in the region or changing the position. For example, the ratio of each of the operation regions RA1, RA3A, RA3B, and RA2 to the lever stroke is as follows.

Neutral region RA1: 0% or more and less than 15%

Very low speed region RA3A: 15% or more and less than 45%

Intermediate speed region RA3B: 45% or more and less than 75%

Full operation vicinity region RA2: 75% to 100%

In the characteristic diagram shown in FIG. 5, when the operation lever 55 is operated from the G0 position to the G1 position, the secondary pilot pressure (Pa) is generated, and when the operation lever 55 is operated from the G1 position to the G4 position, the secondary pilot pressure increases from Pa to Pb in proportion to the operation amount of the operation lever 55. Further, at the G4 position, the primary pilot pressure is short-cut and flows to the secondary side, and the secondary pilot pressure rises from Pb to the maximum output pressure Pc at once. While the operation lever 55 is operated from the G4 position to the G5 position, the secondary pilot pressure is constant at the maximum output pressure (Pc) and is equal to the primary pilot pressure. That is, the operation device 56 outputs the primary pilot pressure input to the operation device 56 to the first port PLa and the fourth port PRb when the shift of the operation lever 55 from the neutral position for instructing the movement in the left direction is equal to or larger than the first shift value (shift from G0 to G4). In the following embodiments, operating the operation lever 55 between the G4 position and the G5 position is referred to as operating the operation lever 55 with a full stroke. The operation device 56 outputs the primary pilot pressure input to the operation device 56 to the second port PLb and the third port PRa when the shift of the operation lever 55 from the neutral position for instructing the movement in the right direction is equal to or larger than a first shift value (shift from G0 to G4). The operation device 56 outputs the primary pilot pressure input to the operation device 56 to the first port PLa and the third port PRa when the shift of the operation lever 55 from the neutral position for instructing the movement in the forward direction is equal to or greater than a first shift value (shift from G0 to G4). The operation device 56 outputs the primary pilot pressure input to the operation device 56 to the second port PLb and the fourth port PRb when the shift of the operation lever 55 from the neutral position for instructing the movement in the rearward direction is equal to or larger than a first shift value (shift from G0 to G4). The characteristic value of the secondary pilot pressure in the front-rear direction may be different from the characteristic value of the secondary pilot pressure in the right-left direction. When the characteristic values of the secondary pilot pressure in the front-rear direction corresponding to G0 to G5 and Pa to Pc are G0' to G5' and Pa' to Pc', the operation device 56 may output the primary pilot pressure input to the operation device 56 to the first port PLa and the third port PRa when the shift of the operation lever 55 from the neutral position for instructing the movement in the front direction is equal to or larger than the second shift value (shift from G0' to G4'). The operation device 56 may output the primary pilot pressure input to the operation device 56 to the second port PLb and the fourth port PRb when the shift of the operation lever 55 from the neutral position for instructing the movement in the rearward direction is equal to or larger than a second shift value (shift from G0' to G4'). Further, Pa and Pb (Pa' and Pb') are values that do not depend on the magnitude of the primary pilot pressure, but when the primary pilot pressure is lower than Pa or Pb (Pa' or Pb'), the secondary pilot pressure reaches the maximum at the magnitude of the primary pilot pressure. That is, the operation valve (OVA, OVB, OVC, OVD) is configured to convert the pressure of the pilot oil from the primary pilot pressure to the secondary pilot pressure in accordance with the first operation amount (the position of the operation lever 55) of the operation device 56 and output the pilot oil. The pilot oil of the secondary pilot pressure is applied to ports (PLa, PRa, PLb, PRb) for providing oil pressure to swash plates of the hydraulic pumps (7L, 7R). When the first operation amount is equal to or larger than a threshold amount (first displacement value), the operation valve (OVA, OVB, OVC, OVD) converts the primary pilot pressure into a secondary pilot pressure equal to the primary pilot pressure.

Based on the characteristics of the operation valves OVA, OVB, OVC, and OVD, the movement of the work vehicle 1 corresponding to the operation of the operation lever 55 will be described in more detail. When the operation amount of the operation lever 55 in the front-rear direction is larger than the operation amount in the right direction, the operation position in the right direction is operated from the G1 position to the G3 position, the left hydraulic pump 7L rotates in the same direction in a state where the magnitude of the rotation speed of the left hydraulic pump 7L is larger than the magnitude of the rotation speed of the right hydraulic pump 7R, whereby the work vehicle 1 turns right in a large circle. When the operation position of the operation lever 55 in the right direction becomes the same position as the operation position in the front-rear direction, the rotation speed of the right hydraulic pump 7R becomes 0, and only the left hydraulic pump 7L rotates, whereby the work vehicle 1 make a right pivot turn (right pivot turn). Further when the operation lever 55 is operated when the operation position in the right direction is between the G4 position and G5 position, the operation amount becomes larger than that of the operating position in the longitudinal direction, the output shaft of the left hydraulic pump 7L rotates in the normal direction and the output shaft of the right hydraulic pump 7R rotates in the reverse direction, so that the work vehicle 1 turns to the right side.

Further, when the operation amount of the operation lever 55 in the front-rear direction is larger than the operation amount of the operation lever 55 in the left direction and the operation position of the operation lever 55 in the left direction is operated from the G1 position to the G3 position, the right hydraulic pump 7R rotates in the same direction in a state where the magnitude of the rotation speed of the right hydraulic pump 7R is larger than the magnitude of the rotation speed of the left hydraulic pump 7L, whereby making the work vehicle curve advance to the left with a long turn. When the operation position of the operation lever 55 in the left direction is the same as the operation position in the front-rear direction, the rotation speed of the left hydraulic pump 7L becomes 0, and only the right hydraulic pump 7R rotates, this allows the work vehicle 1 pivot turn to the left. Further, when the operation lever 55 is operated to the left between the G4 position and the G5 position, the operation amount becomes larger than that of the operation position in the front-back direction, the right hydraulic pump 7R rotates in the normal direction, and the left hydraulic pump 7L rotates in the reverse direction, whereby making the work vehicle turn to the left. In the present embodiment, turning refers to the operation of the work vehicle 1 when the operation position in the right direction is operated between the G4 position to the G5 position, or when the operation position in the left direction is operated from the G4 position to the G5 position.

On the other hand, when the operation lever 55 is operated to the forward operation position between the G4 position and the G5 position, the operation amount becomes larger than that of the operation position in the lateral direction, and the left and right hydraulic pumps 7L and 7R rotate in the normal direction to move the work vehicle 1 forward at high speed. When the operation lever 55 is operated to the position between the G4 position and the G5 position, the operation amount in the rearward direction becomes larger than the operation amount in the lateral direction, and the drive shaft of the left and right hydraulic pumps 7L and 7R are reversed to move the work vehicle 1 backward at high speed. The other operations of the operation lever 55 in the front-rear direction are the same as those in the right-left direction.

Figure 6:
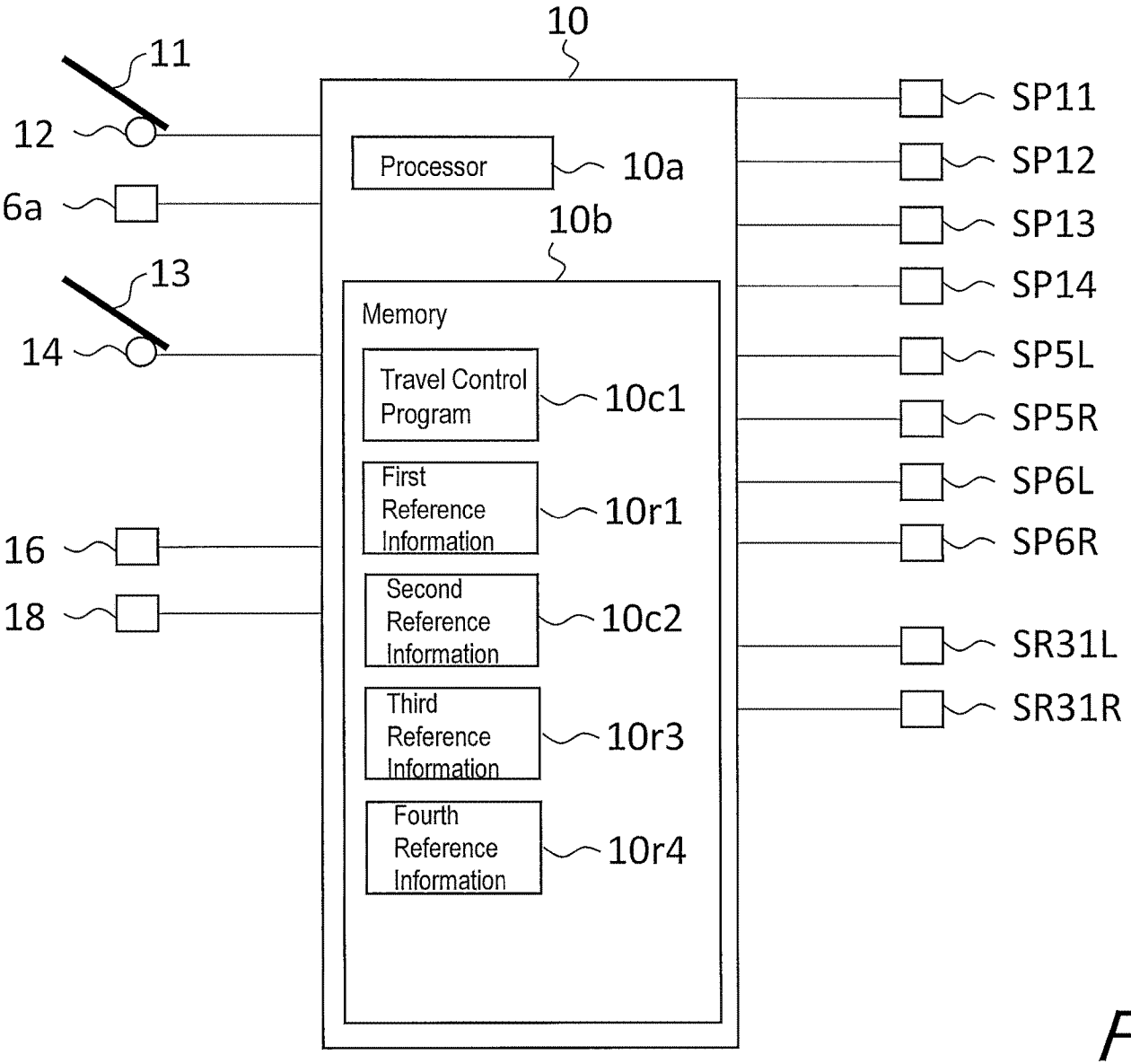
FIG. 6 is a block diagram of the work vehicle.

The work vehicle 1 is provided with various switches and sensors connected to the controller 10 described above. FIG. 6 is a block diagram of the work vehicle 1. Referring to FIG. 6, the work vehicle 1 includes a creep setting member 16 provided around the driver's seat 54. The creep setting member 16 may be referred to as an human-machine interface. The human-machine interface includes, for example, a lever, a switch, a button, a dial, a pedal, or a button shown on a touch panel. More specifically, the creep setting member 16 is constituted by, for example, a touch panel, a slidable slide switch, or a dial. Creeping refers to control for causing the work vehicle 1 to travel at a speed equal to or lower than the upper limit speed regardless of the operation amount of at least one operation device (the setting member 11, one or more operation levers 55) to which a speed change operation is input by the user. An upper limit speed is input by the creep setting member 16. The creep setting member 16 is configured to switch between a normal mode and a creep mode. A state in which the upper limit speed is set by the creep setting member 16 is referred to as a creep mode. A state other than the creep mode is referred to as a normal mode.

In the normal mode, the target rotation speed of the engine 6 is set by the operation of the setting member 11, and the primary pilot pressure corresponding to the target rotation speed is obtained based on the setting line L1 or L2 of FIG. 4. Then, the secondary pilot pressure is set based on the operation amount of one or more operation levers 55, and the hydraulic motors (31L, 31R) and the hydraulic pumps (7L, 7R) are controlled. That is, in the normal mode, the speed of the work vehicle 1 can be changed in accordance with the operation amount of at least one operation device, and the work vehicle 1 can be made to travel at a speed higher than the upper limit speed. On the other hand, in the creep mode, the setting line L1 or L2 of FIG. 4 is not used to determine the primary pilot pressure, and the primary pilot pressure is determined to be lower than the primary pilot pressure in the normal mode by using first reference information 10*r*1 or the like described later. The setting of the secondary pilot pressure and thereafter in the creep mode is the same as in the normal mode, but the secondary pilot pressure is equal to or lower than the primary pilot pressure, and therefore, by limiting the primary pilot pressure, the speed of the work vehicle 1 is limited to be equal to or lower than the upper limit speed regardless of the operation amount of at least one operation device (the setting member 11, one or more operation levers 55).

Referring to FIGS. 3 and 6, the work vehicle 1 includes a hydraulic sensor SP11 for detecting the hydraulic pressure of the first pilot oil passage PA11, a hydraulic sensor SP12 for detecting the hydraulic pressure of the second pilot oil passage PA12, a hydraulic sensor SP13 for detecting the hydraulic pressure of the third pilot oil passage PA13, and a hydraulic sensor SP14 for detecting the hydraulic pressure of the fourth pilot oil passage PA14. As described above, the secondary pilot pressure output from the secondary side port of each of the operation valves OVA, OVB, OVC, and OVD changes in accordance with the operation position of the operation lever 55. Therefore, the hydraulic sensors SP11 to SP14 are sensors for detecting the secondary pilot pressure. The hydraulic sensors SP11 to SP14 may be referred to as additional hydraulic sensors.

The work vehicle 1 includes a hydraulic sensor SP5L for detecting the hydraulic pressure of the driving oil passage PA5L, a hydraulic sensor SP6L for detecting the hydraulic pressure of the driving oil passage PA6L, a hydraulic sensor SP5R for detecting the hydraulic pressure of the driving oil passage PA5R, and a hydraulic sensor SP6R for detecting the hydraulic pressure of the driving oil passage PA6R. That is, the hydraulic sensors (SP5L, SP6L, SP5R, SP6R) are configured to detect the hydraulic pressure of the hydraulic fluid in the driving oil passages (PA5L, PA6L, PA5R, PA6R). The states of the left hydraulic motor 31L and the right hydraulic motor 31R can be detected from the difference between the pressures of the hydraulic sensor SP5L and the hydraulic sensor SP6L and the difference between the pressures of the hydraulic sensor SP5R and the hydraulic sensor SP6R.

Referring to FIGS. 2, 3, and 6, the work vehicle 1 further includes a rotation speed sensor SR31R connected to the rotation shaft of the left hydraulic motor 31L and configured to detect the rotation speed of the left hydraulic motor SR31L at every sampling interval Ts (for example, 20 s) and a rotation speed sensor SR31R configured to detect the rotation speed of the right hydraulic motor 31R at every sampling interval Ts. The states of the left hydraulic motor 31L and the right hydraulic motor 31R can be detected from the magnitude of the rotational direction and the rotational speed detected by the rotation speed sensor SR31R and the magnitude of the rotational direction and the rotation speed detected by the rotation speed sensor SR31L. The work vehicle 1 may include an operation detection sensor 18 configured to detect the operation position of the operation lever 55. The operation detection sensor 18 is connected to the controller 10 described later. The operation detection sensor 18 is a position sensor or the like that detects the position of the operation lever 55.

<Configuration of Controller 10>

The controller 10 includes a processor 10*a* and a memory 10*b* as shown in FIG. 6 in order to realize the control of the vehicle speed in the creep mode. The processor 10*a* may be referred to as a hardware processor or circuitry (examples of operation detection circuitry, determination circuitry, pump control circuitry, prime mover control circuitry, and motor rotation detection circuitry). The operation detection circuitry, the determination circuitry, the pump control circuitry, the prime mover control circuitry, and the motor rotation detection circuitry may be integrated into a single circuitry or may be separated from each other. The memory 10*b* includes a volatile memory and a non-volatile memory. The memory 10*b* includes a travel control program 10*c*1 for realizing the above-described control, first reference information 10*r*1, and second reference information 10*r*2.

The first reference information 10*r*1 represents a first correspondence relationship between the rotation speed RS of the engine 6 detected by the speed sensor 6*a* and the primary pilot pressure in the normal mode. That is, the first reference information 10*r*1 represents the first correspondence relationship represented by the setting line L1 of FIG. 4. The second reference information 10*r*2 represents a second correspondence relationship between the rotation speed RS of the engine 6 detected by the speed sensor 6*a* and the primary pilot pressure, which is used for controlling the primary pilot pressure when the drop amount of the engine 6 is large in the normal mode. That is, the second reference information 10*r*2 represents the second correspondence relationship represented by the setting line L2 of FIG. 4.

The processor 10*a* executes the following control while executing the travel control program 10*r*1 with reference to the first reference information 10*r*1 and the second reference information 10*r*2. First, the processor 10*a* is configured to acquire the rotation speed RS of the engine 6 from the speed sensor 6*a* when the normal mode is selected by the creep setting member 16, to obtain the primary pilot pressure corresponding to the detected rotation speed RS of the engine 6 from the first reference information 10*r*1, and to control the primary pressure control valve CV1 so as to achieve the obtained primary pilot pressure. When the drop amount of the engine 6 is large when the normal mode is selected, the processor 10*a* (examples of determination circuitry and pump control circuitry) obtains the primary pilot pressure corresponding to the rotation speed RS of the engine 6 detected by the speed sensor 6*a* from the second reference information 10*r*2, and configured to control the primary pressure control valve CV1 so as to achieve the obtained primary pilot pressure.

The memory 10*b* further includes third reference information 10*r*3 and fourth reference information 10*r*4. When the creep mode is selected by the creep setting member 16, the processor 10*a* determines the target rotation speed RSi of the hydraulic motors (31L, 31R) by receiving the upper limit speed input by the creep setting member 16. The target rotation speed RSi is the target rotation speed RSiL of the hydraulic motors (31L, 31R) when the work vehicle 1 is assumed to travel straight. When the operation lever 55 is operated in this state, the operation device 56 sets the secondary pilot pressure based on the characteristics as shown in FIG. 5. However, as shown in FIG. 5, the secondary pilot pressures are pressures that maximize the primary pilot pressures, and considering that the operation lever 55 is normally operated to be tilted to the maximum in the creep mode, the primary pilot pressures are examples of control parameters for setting the displacement volumes of the hydraulic pumps (31L, 31R) configured to supply the hydraulic motors (31L, 31R) with the hydraulic fluid. In the present embodiment, the primary pressure control valve CV1 is an example of the control mechanism (hydraulic control circuit) configured to control the hydraulic pressure of the pilot oil that changes the displacement volumes of the hydraulic pumps (31L, 31R). Since the primary pilot pressure is determined based on the current applied to the solenoid of the primary pressure control valve CV1 (control mechanism, hydraulic control circuit), the control parameter may be a current value (control current value) for controlling the primary pressure control valve CV1 (control mechanism, hydraulic control circuit). In the following description of the present embodiment, the control parameter is a current value for controlling the primary pressure control valve CV1 (control mechanism, hydraulic control circuit).

In the creep mode, the processor 10*a* sets the target rotation speed of the engine 6 based on the operation amount of the creep setting member 16. The processor 10*a* (an example of prime mover control circuitry) outputs a rotation command indicating, for example, a fuel injection amount, an injection timing, and a fuel injection rate to the injector so that the determined target rotation speed of the engine 6 (an example of prime mover) is achieved. Alternatively, the processor 10*a* outputs a rotation command indicating a fuel injection pressure and the like to the supply pump and the common-rail so that the determined target rotation speed of the engine 6 is achieved. For example, the processor 10*a* may rotate the engine 6 at the same predetermined rotation speed at all the target rotation speeds RSi. When the setting member 11 is operated in the creep mode, the target rotation speed RSi or the target rotation speed RSiL of the engine 6 may be changed in response to the operation, as in the case of the creep setting member 16, instead of changing the target rotation speed of the engine 6 as in the normal mode.

Figure 7:
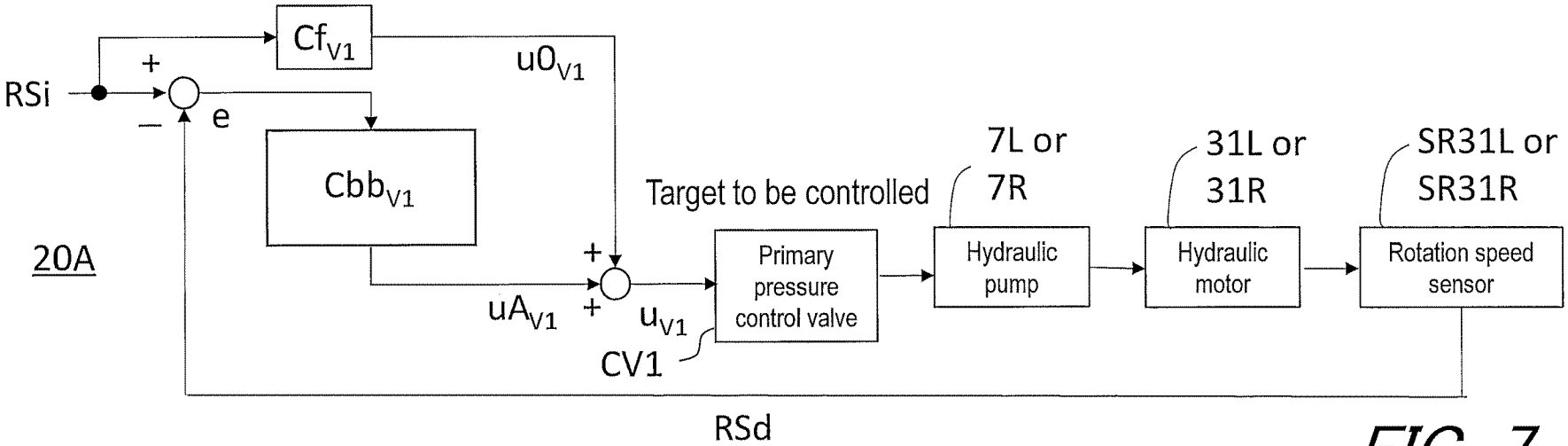
FIG. 7 is a control block diagram in the first embodiment.

FIG. 7 is a control block diagram in the creep mode in the first embodiment. The control system 20A according to the first embodiment includes a feedforward controller $Cf_{v1}$ and a feedback controller $Cbb_{v1}$. The feedforward controller $Cf_{v1}$ outputs the control current value $u0_{v1}$ of the primary pressure control valve CV1 corresponding to the target rotation speed RSi of the hydraulic motor (31L 31R). The memory 10*b* stores a list or a conversion formula of the control current value $u0_{V1}$ corresponding to the target rotation speed RSi. The processor 10*a* calculates the target rotation speed RSi of the hydraulic motor (31L, 31R) from the upper limit speed input by the creep setting member 16. The processor 10*a*, which executes the feedforward controller $Cf_{v1}$, derives the control current value $u0_{V1}$ from the calculated target rotation speed RSi by using a stored list or a conversion formula. The determined control current value $u0_{V1}$ is referred to as a reference value of the control parameter.

The control current value $u0_{V1}$ is preferably derived from the target rotation speed RSi based on the following. As described above, the processor 10*a* calculates the reference value $u0_{v1}$ of the control current value of the primary pressure control valve CV1 so that the hydraulic motors (7L, 7R) rotate at the target rotation speed RSi in a state where the left and right traveling devices (3L, 3R) do not receive resistance from the road surface when the rotation speed of the engine 6 in the creep mode is known from the target rotation speed RSi and the primary pilot pressure corresponding to the target rotation speed RSi is applied to the hydraulic pumps (31L, 31R).

The feedback controller $Cbb_{v1}$ is configured to derive an offset value $uA_{V1}$ corresponding to a speed difference e of larger absolute values among speed differences e (eL, eR) obtained by subtracting the target rotation speed RSi from the rotation speeds (RSdL, RSdR) of the hydraulic motors (31L, 31R) detected by the rotation speed sensors (SR31L, SR31R) at every sampling interval Ts. The processor 10*a* (examples of motor rotation detection circuitry and determination circuitry) is configured to receive the rotation speeds (RSdL, RSdR) of the hydraulic motors (31L, 31R) detected at every sampling interval Ts from the rotation speed sensors (SR31L, SR31R) and calculate the speed difference e (eL, eR) obtained by subtracting the target rotation speed RSi from the rotation speeds (RSdL, RSdR) at the every sampling interval Ts. The processor 10*a* (an example of determination circuitry) is configured to calculate the offset value $uA_{V1}$ corresponding to the speed difference e having a larger absolute magnitude of the speed differences e (eL, eR) at every sampling interval Ts. The processor 10*a* (an example of determination circuitry) input the sum of the reference value $u0_{v1}$ and the offset value $uA_{v1}$ to the primary pressure control valve uv1 as the control parameter uv1. That is, the processor 10*a* (an example of determination circuitry) applies the current of the control current value uv1 to the solenoid of the primary pressure control valve CV1. The processor 10*a* (an example of pump control circuitry) sends a command corresponding to the control parameter uv1 to the primary pressure control valve CV1 (control mechanism, hydraulic control circuit) which controls the displacement volume of the hydraulic pumps (7L, 7R). The processor 10*a* thereby controls the displacement volume of the hydraulic pumps (7L, 7R) in response to the control parameter uv1 described above. The processor 10*a* rotates the hydraulic motors (31L, 31R) by controlling the engine 6 to rotate the hydraulic pumps (7L, 7R).

Figure 8:
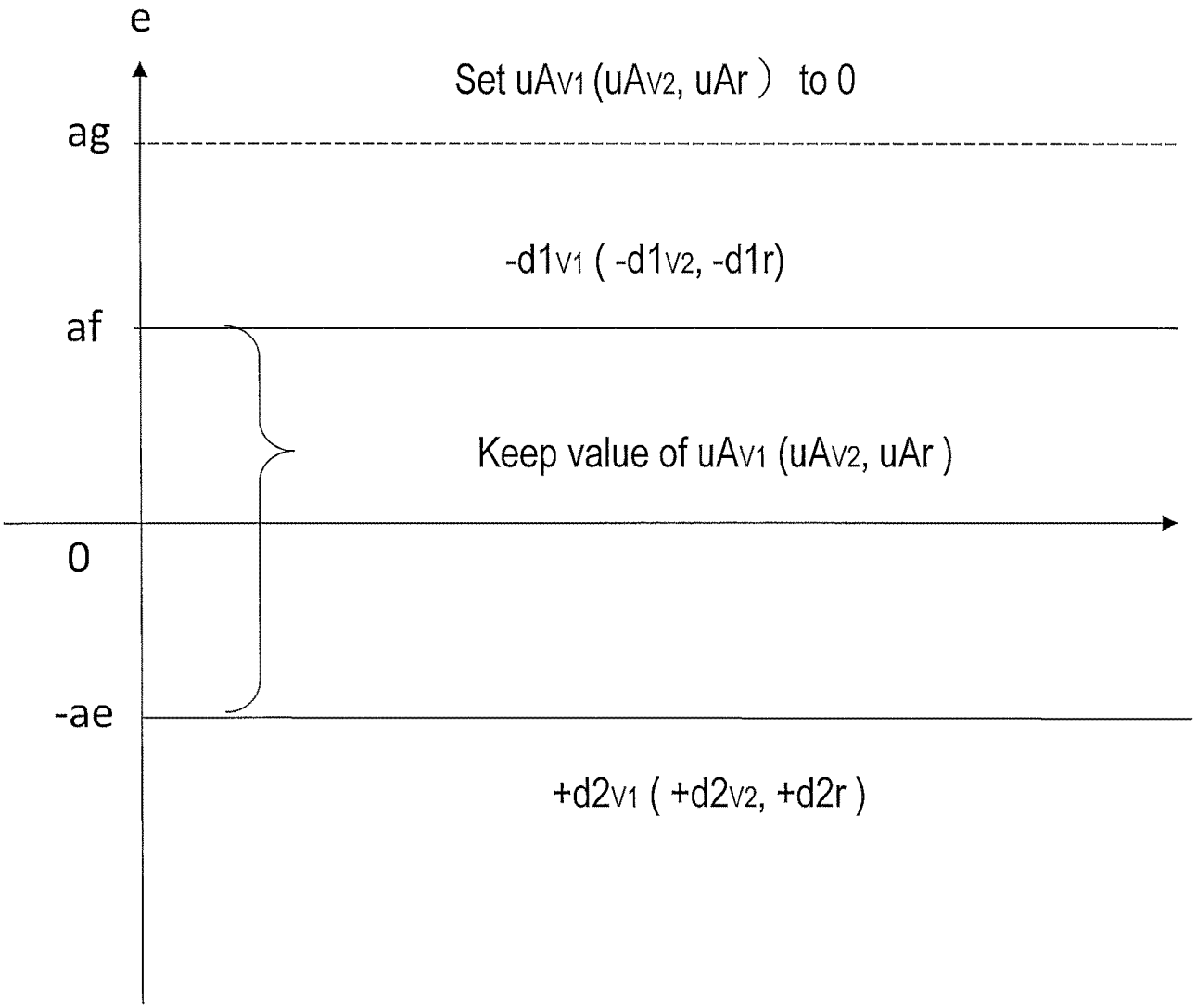
FIG. 8 is a diagram showing the relationship between the speed difference and the method of updating the offset value in the embodiment.

The processor 10*a* updates the control parameter uv1 at every sampling interval Ts. More specifically, the processor 10*a* updates the offset value uAV1 at every sampling interval Ts. FIG. 8 is a diagram showing a relationship between the speed difference e and the method of updating the offset value $uA_{V1}$ in the embodiment. Referring to FIG. 8, the processor 10*a* is configured to: (1) subtract a first feedback control value dlvi from the offset value $uA_{V1}$ to reduce the displacement volume when the speed difference e is greater than a predetermined positive first threshold value af; (2) add a second feedback control value $d2_{V1}$ to the offset value $uA_{V1}$ to increase the displacement volume when the speed difference e is less than a predetermined negative second threshold value −ae; (3) not change the offset value $uA_{V1}$ when the speed difference e is between the second threshold value −ae and the first threshold value af; and (4) update the offset value $uA_{V1}$ to become zero when the speed difference e is greater than a third threshold value ag that is greater than the first threshold value af.

The processor 10*a* is configured to perform the operations as above-described processing to increase, decrease, maintain and reset the offset value $uA_{V1}$ at every sampling interval Ts with reference to the speed difference e. That is, when the speed difference e is continuously smaller than the predetermined negative second threshold value −e for a time period five times a sampling interval Ts, the offset value $uA_{V1}$ is increased to five time of the second feedback control value $d2_{v1}$. The initial value of the offset value $uA_{V1}$ is 0. Since the reference value $u0_{V1}$ of the control current value is a value that is assumed to have no external load, the speed difference e tends to be negative at the beginning of the control only by the control using the reference value $u0_{V1}$, and the speed difference e is generally smaller than the second threshold value −ae, and the offset value $uA_{V1}$ becomes positive by adding the third feedback control value $uA_{V1}$ described later. Further, the processor 10*a* is configured to set the control parameter $u_{V1}$ to the upper limit value $u_{maxv1}$ when the value ($u_{V1}$) obtained by adding the offset value uAv1 to the reference value $u0_{v1}$ exceeds the predetermined upper limit value $u_{maxv1}$.

When the speed difference e is smaller than the predetermined negative second threshold value −ae, the speed difference e is increased to the second feedback control value d2v1, whereby the offset value uAV1 is increased at the time of standstill when the running resistance is large, and the time until the start of running can be shortened. The absolute values d1v1 of the first feedback control value are larger than the absolute value d2v1 of the second feedback control value. Thus, the offset value uAV1 is rapidly decreased, and thereby it is possible to prevent the work vehicle 1 from being excessively accelerated due to a large decrease in the travel resistance at the start of the movement.

Further, the processor 10*a* is configured to add a third feedback control value d3v1 that is larger than the second feedback control value d2v1 to the offset value uAv1 when the operation lever 55 is shifted from the neutral position. Since the operation lever 55 is often set to the neutral position when the work vehicle 1 is stationary, the offset value $uA_{v1}$ can be rapidly increased when the torque of the hydraulic motors (31L, 31R) is required from the stationary state to the start of movement, and thus the time until the start of travel can be shortened.

<Operation of Work Vehicle According to First Embodiment>

Figure 9:
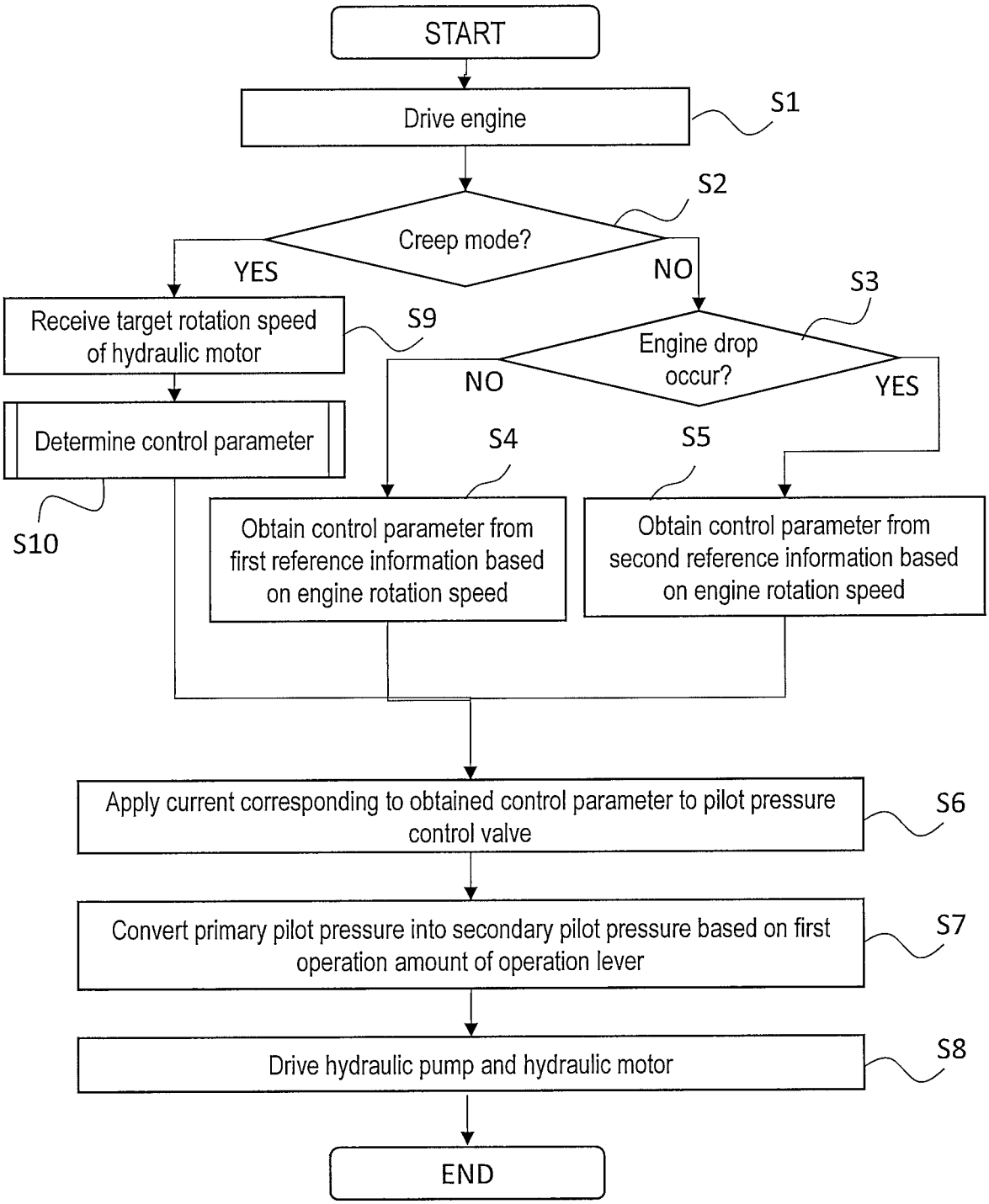
FIG. 9 is a flowchart showing the operation of the work vehicle according to the first embodiment.

FIG. 9 is a flowchart showing the operation of the work vehicle 1 according to the first embodiment. In this flowchart, the processing from step S1 to step S25 is executed at every predetermined sampling interval (for example, 20 s). In step S1, the processor 10*a* drives the engine 6. In step S2, the processor 10*a* determines whether or not the creep mode is selected by the creep setting member 16. That is, the control method according to the present embodiment includes determining whether or not the creep mode is selected by the creep setting member 16. When the creep mode is set, that is, when the upper limit speed is set (Yes in step S2), the process proceeds from step S9 to S10. When the normal mode is set, that is, when the upper limit speed is not set, or when the upper limit speed which does not have the first correspondence or the second correspondence and is not valid is set (No in step S2), the process proceeds to step S3.

In the normal mode (No in step S2), in step S3, the processor 10*a* acquires the rotation speed RS of the engine 6 detected by the speed sensor 6*a*. Then, the processor 10*a* determines whether or not there is an engine drop. That is, in step S9, the processor 10*a* is configured to determine whether the amount of decrease ΔE1 of the engine 6 is equal to or greater than an anti-stall determination value. When the engine drop does not occur (No in step S3), in step S4, the processor 10*a* obtains the control parameter (the control current value of the primary pressure control valve CV1) corresponding to the primary pilot pressure from the first reference information 10*r*1 based on the rotation speed RS of the engine 6. When the engine drop is present (Yes in step S3), in step S5, the processor 10*a* obtains a control parameter (a control current value of the primary pressure control valve CV1) corresponding to the primary pilot pressure from the second reference information 10*r*2 based on the rotation speed RS of the engine 6. After the process of step S4 or step S5 is completed, the process of step S6 is executed.

In step S6, the processor 10*a* applies a current corresponding to the control parameter (the control current value of the primary pressure control valve CV1) obtained in step S4 or step S5 to the solenoid of the primary pressure control valve CV1 which sends to operation valve OVA, OVB, OVC, OVD. That is, the control method according to the present embodiment includes controlling the displacement volume of the hydraulic pumps (7L, 7R) in accordance with the control parameter (the control current value of the primary pressure control valve CV1). In step S7, the operation valves OVA, OVB, OVC, and OVD convert the primary pilot pressure into the secondary pilot pressure based on the operation lever 55 position (first operation amount) of the operation lever 55 (first operation device). In step S8, the pilot oil of the secondary pilot pressure is applied to ports (PLa, PRa, PLb, PRb) for providing hydraulic pressure to swash plates of hydraulic pumps (7L, 7R), and thereby the hydraulic pumps (7L, 7R) and the hydraulic motors (31L, 31R) are controlled. By means of the steps S1 and S8, the processor 10*a* is configured to rotate the hydraulic motors (31L, 31R) via the hydraulic pumps (7L, 7R) by sending commands to the engine 6 to drive the engine 6, which is configured to rotate the hydraulic pumps (7L, 7R), in response to the control parameters. The control method according to the present embodiment includes rotating the hydraulic motors (31L, 31R) by rotating the hydraulic pumps (7L, 7R).

In the creep mode (Yes in step S2), in step S9, the processor 10*a* receives an input corresponding to the target rotation speed RSi of the hydraulic motor (31L, 31R) configured to drive the traveling device (3L, 3R) from the creep setting member 16. That is, the control method according to the present embodiment acquires the target rotation speed RSi of the hydraulic motor (31L, 31R) configured to drive the traveling device (3L, 3R) via the creep setting member 16. In step S10, the processor 10*a* performs the processing of the feedforward controller $Cf_{v1}$ and the feedback controller $Cbb_{v1}$, and outputs the control parameter $u_{V1}$. That is, the control method according to the present embodiment includes determining the control parameter $u_{V1}$ for setting the displacement volume of the hydraulic pumps (7L, 7R) configured to supply the hydraulic motors (31L, 31R) with the hydraulic fluid in response to the operation of the creep setting member 16. Thereafter, in steps S6 to S8, the same control as in the normal mode is performed.

Figure 10:
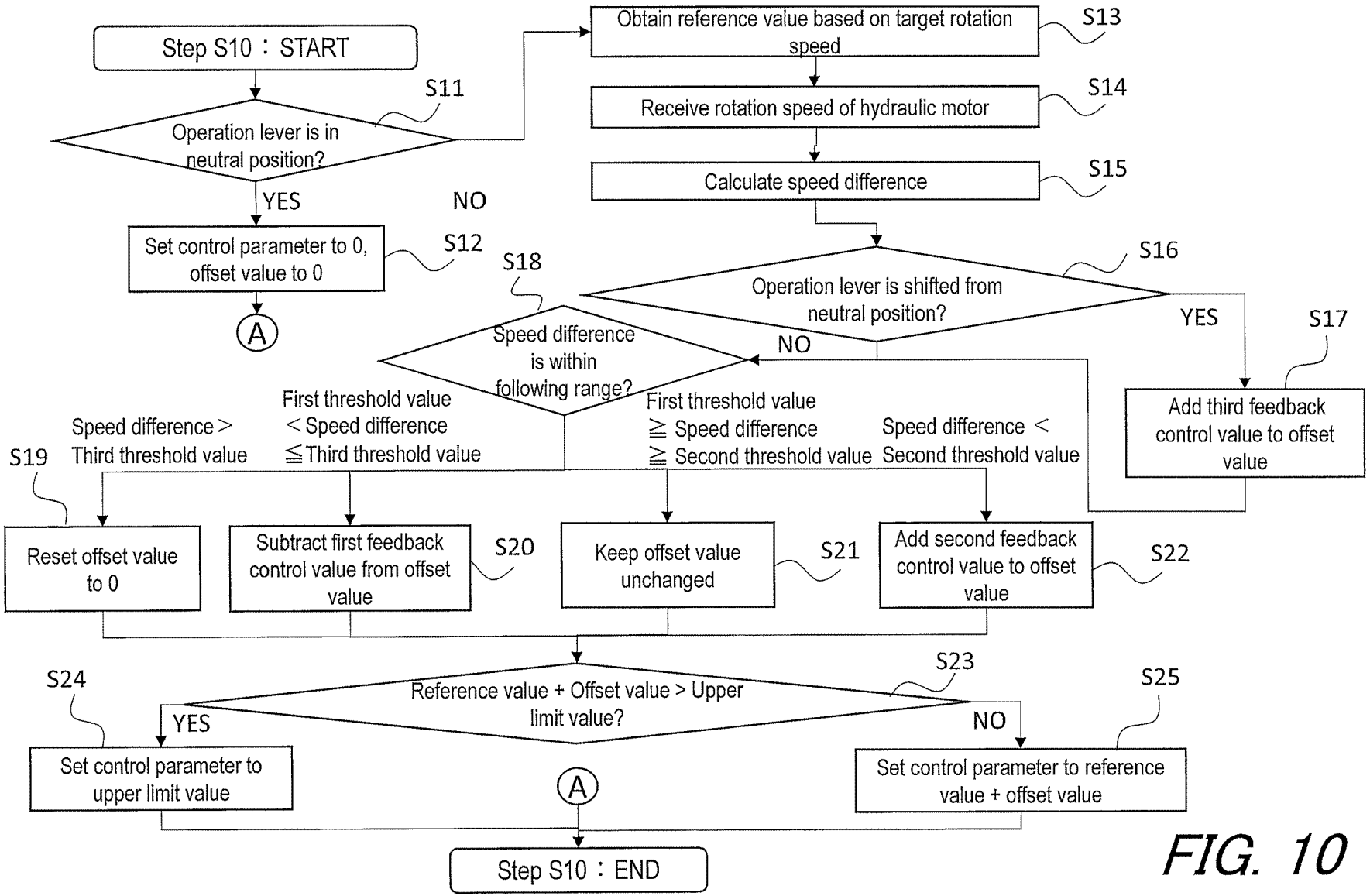
FIG. 10 is a flowchart showing a method of determining a control parameter.

FIG. 10 is a flowchart showing a method of determining the control parameter $u_{v1}$ S10 in step 10. In step S11, the processor 10*a* determines whether or not the operation lever 55 is in the neutral position. To be specific, the processor 10*a* determines whether or not the operation lever 55 is in the neutral region RA1, based on the outputs of the hydraulic sensors (SP5L, SP6L, SP5R, SP6R). For example, the processor 10*a* can determine whether the operation lever 55 is in the neutral region RA1 by determining whether the secondary pilot pressure obtained from the output of the hydraulic sensor (SP5L, SP6L, SP5R, SP6R) based on the characteristics of FIG. 5 can be regarded as Pa or less of FIG. 5.

When the operation lever 55 is in the neutral position (Yes in step S11), the processor 10*a* sets the control parameter $u_{V1}$ to 0 and resets the offset value $u_{V1}$ to 0 in step 12.

When the operation lever 55 is not in the neutral position (No in step S11), in step S13, the processor 10*a* obtains the reference value $u0_{V1}$ of the control parameter $u_{V1}$ based on the target rotation speed RSi. In step S13, the processor 10*a* receives the rotation speeds (RSdL, RSdR) of the hydraulic motors (31L, 31R) detected at every sampling interval Ts from the rotation speed sensors (SR31L, SR31R). In step S15, the processor 10*a* calculates the speed difference e (eL, eR) obtained by subtracting the rotation speed (RSdL, RSdR) from the target rotation speed RSi at every sampling interval Ts.

Next, in step S16, the processor 10*a* determines whether or not the operation lever 55 is shifted from the neutral position. The processor 10*a* may determine that the operation lever 55 is in the neutral position at the immediately preceding sampling time and determine whether the operation lever 55 is determined not to be in the neutral position at step S11 at the current sampling time, but the processor 10*a* may determine that the operation lever 55 is shifted from the neutral position when the operation lever 55 is determined not to be in the neutral position at step S11 continuously for a predetermined multiple of the sampling interval Ts in consideration of noise or the like and the operation lever 55 is determined not to be in the neutral position immediately before that.

When it is determined that the operation lever 55 is shifted from the neutral position (Yes in step S16), in step S17, the processor 10*a* adds the third feedback control value $d3_{v1}$ to the offset value $uA_{v1}$. If it is determined that the operation lever 55 is not shifted from the neutral position (No in step S16) or if step S17 is finished, the process proceeds to step S18. In step S18, the processor 10*a* determines whether or not the speed difference e of which the absolute value is larger among the speed difference (eL, eR) is within the following range.

When the speed difference e is larger than the third value ag, in step S19, the processor 10*a* resets the offset value $uA_{v1}$ to 0. When the speed difference e is larger than the first reference value af and equal to or smaller than the third reference value ag, the processor 10*a* subtracts the first feedback control value $d1_{v1}$ from the offset value $uA_{v1}$ in step S20. When the speed difference e is equal to or less than the first threshold value af and equal to or more than the second threshold value −ae, in step S21, the processor 10*a* does not change the offset value $uA_{v1}$. When the speed difference e is smaller than the second threshold value −ae, the processor 10*a* adds the second feedback control value $d2_{v1}$ to the offset value $uA_{V1}$ in step S22. By processing from step S19 to step S22, the processor 10*a* calculates the offset value $uA_{V1}$ corresponding to the speed difference e at every sampling interval Ts.

In step S23, the processor 10*a* determines whether or not the sum of the reference value $u0_{V1}$ and the offset value $uA_{V1}$ exceeds a predetermined upper limit value $u_{maxv1}$. When the sum of the reference value $u0_{V1}$ and the offset value $uA_{V1}$ exceeds the upper limit value $u_{maxv1}$ (Yes in step S23), in step S24, the processor 10*a* set the control parameter $u_{V1}$ as the upper limit value $u_{maxv1}$. When the sum of the reference value $u0_{V1}$ and the offset value $uA_{V1}$ is equal to or smaller than the upper limit value $u_{maxv1}$ (No in step S23), in step S25, the processor 10*a* updates the control parameter $u_{V1}$ at every sampling interval Ts by setting the control parameter $u_{V1}$ to a value obtained by adding the offset value to the reference value.

Operation and Effects of First Embodiment

The work vehicle 1 according to the present embodiment adds the second feedback control value $d2_{v1}$ to the offset value $uA_{V1}$ when the speed difference e is smaller than the second threshold value −ae. Therefore, even when the travel resistance is large at the start of travel of the work vehicle 1, the travel can be started quickly. When the speed difference e is greater than the first threshold value af and equal to or less than the third threshold value ag, the work vehicle 1 subtracts the first feedback control value $d1_{v1}$, which is greater than the second feedback control value $d2_{v1}$, from the offset value $uA_{v1}$. Furthermore, when the speed difference e is greater than the third threshold value ag, in step S19, the processor 10*a* resets the offset value $uA_{v1}$ to 0. Therefore, it is possible to prevent the work vehicle 1 from being excessively accelerated due to a large decrease in the travel resistance at the start of movement.

Modification Example of First Embodiment

As a modification of the first embodiment, the control system 20A may be a combination of the feedback controller $Cb_{v1}$ described in United States Patent Application Publication No. 2024/0060274 A1 as a feedback controller. United States Patent Application Publication No. 2024/0060274 A1 is incorporated by reference. Alternatively, the control system 20A may be a combination of the feedback controllers $Cb_{v11}$ and $Cb_{v12}$ described in United States Patent Application Publication No. 2024/0060274 A1 as a feedback controller.

Second Embodiment

Figure 11:
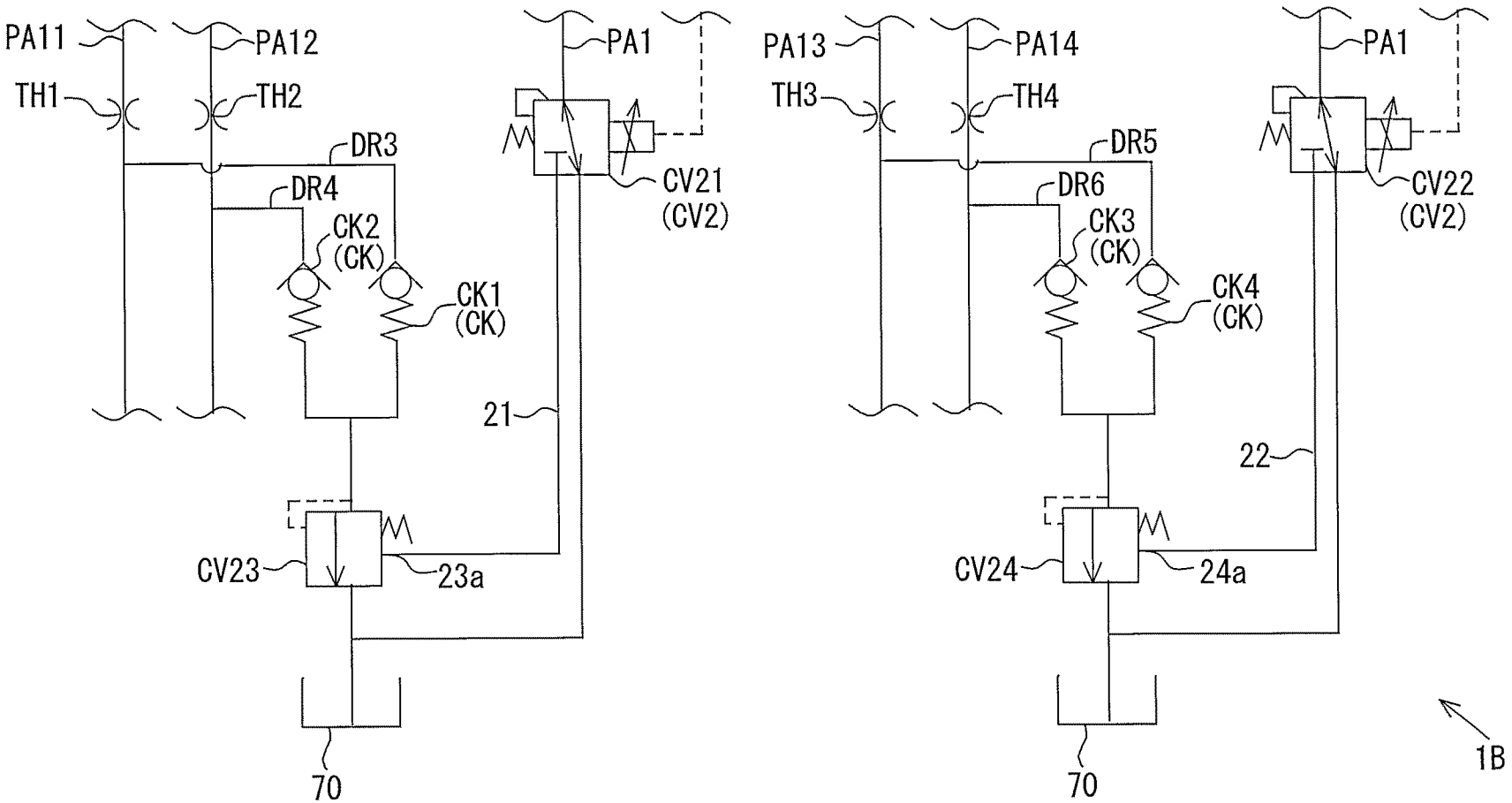
FIG. 11 is a hydraulic circuit diagram of the travel system of the work vehicle in the second embodiment.

In the first embodiment, the primary pilot pressure is controlled to realize the creep mode, but the secondary pilot pressure may be controlled. FIG. 11 is a hydraulic circuit diagram of the travel system of the work vehicle 1 in the second embodiment. FIG. 11 shows a configuration added to FIG. 3. In FIG. 11, the same components as those in FIG. 3 are denoted by the same reference numerals, and detailed description thereof will be omitted. In the second embodiment, the work vehicle 1 includes a hydraulic circuit 1B. The hydraulic circuit 1B is different from the hydraulic circuit 1*a* in the configuration of including relief valves CV23 and CV24, proportional valves CV21 and CV22, discharge oil passages DR3 to DR6, and check valves CK1 to CK4, throttles TH1 to TH4.

The relief valves CV23 and CV24 are balance type relief valves whose set pressures to be opened are variable based on the pressures of the pilot oil, and include control ports 23*a* and 24*a* for receiving the pressures of the pilot oil. The relief valves CV23, CV24 are configured to open when the pressures on the input ports are greater than the pressures on the control ports 23*a*, 24*a*. At this time, the pilot oil is discharged to the hydraulic fluid tank 70. The proportional valves CV21 and CV22 are connected to the hydraulic fluid passages 21 and 22 connected to the control ports 23*a* and 24*a*, and are supplied with pilot fluid from the pilot pump 71. The proportional valves CV21 and CV22 are electromagnetic proportional valves whose opening degrees can be changed by exciting solenoids, and are controlled by the controller 10.

The proportional valves CV21, CV22 are connected to a pilot oil supply passage PA1, and are controlled to be a hydraulic pressure obtained by adding an offset a considering that pilot oil flows out from relief valves CV23, CV24, etc., to a primary pressure control valve CV1 in a first embodiment in the creep mode, and are operated so that the value of the setting line L1 plus the offset a is obtained when the anti-stall control is not performed in the normal mode, and the value of the setting line L2 plus the offset a is obtained when the anti-stall control is performed. The proportional valves CV21 and CV22 may be referred to as secondary pressure control valves CV2.

The controller 10 performs feedback control for controlling the control valves (proportional valves CV21 and CV22) of the pilot pressure of the hydraulic pumps (7L and 7R) based on the speed differences (eL and eR) between the target rotation speed RSi of the hydraulic motors (31L and 31R) corresponding to the target vehicle speed and the detected rotation speeds RSd. The control parameter is input to the secondary pressure control valve CV2 that adjusts the secondary pilot pressure, which is the hydraulic pressure of the pilot oil passage connecting the operation valves OVA, OVB, OVC, and OVD controlled by the travel instruction input device (operation lever 55) to which the user's instruction of the travel direction is input and the pilot ports (PLa, PRa, PLb, and PRb) of the hydraulic pumps (7L and 7R).

The discharge oil passage DR3 is connected to the first pilot oil passage PA11. The discharge oil passage DR4 is connected to the second pilot oil passage PA12. The discharge oil passage DR5 is connected to the third pilot oil passage PA13. The discharge oil passage DR6 is connected to the fourth pilot oil passage PA14. The check valves CK1 to CK4 block the discharge oil passages DR3 to DR4 unless the pressures on the sides of the throttle TH1 to TH4 become higher than the pressures on the sides of the relief valves CV23 and CV24 by a predetermined value or more.

Since the pilot pressure of the discharge oil passage DR3 and the discharge oil passage DR4 becomes high when the left hydraulic pump 7L rotates in the normal direction and the reverse direction, respectively, when the pilot pressure of one of the discharge oil passage becomes equal to the primary pilot pressure, the other becomes significantly smaller than the primary pilot pressure. Since the pilot pressure becomes high when the right hydraulic pump 7R rotates in the normal direction and in the reverse direction, respectively, the pilot pressure of one of the discharge oil passage DR5 and the discharge oil passage DR6 becomes much smaller than the primary pilot pressure when the pilot pressure of the other one of the discharge oil passage DR5 and the discharge oil passage DR6 becomes equal to the primary pilot pressure. Therefore, only one of the check valves CK1 and CK2 is normally opened. Therefore, the above-described control can be executed by controlling the pressures of the proportional valves CV21 and CV22 so that the pressures of the proportional valves CV21 and CV22 are pressures obtained by adding a loss of pressures due to the pilot oil flowing out from the relief valves CV23 and CV24 to the pressures by the control of the primary pressure control valve CV1 according to the first embodiment.

The throttle TH1 is provided on a first pilot oil passage PA11 between the first shuttle valve SVa and the discharge oil passage DR3, and is configured to reduce the flow rate of the pilot oil in the first pilot oil passage PA11. The throttle TH2 is provided in the second pilot oil passage PA12 between the second shuttle valves SVb and the discharge oil passage DR4, and is configured to reduce the flow rate of the pilot oil in the second pilot oil passage PA12. The throttle TH3 is provided in the third pilot oil passage PA13 between the third shuttle valves SVc and the discharge oil passage DR5, and is configured to reduce the flow rate of the pilot oil in the third pilot oil passage PA13. The throttle TH4 is provided in the fourth pilot oil passage PA14 between the fourth shuttle valves SVd and the discharge oil passage DR6, and is configured to reduce the flow rate of the pilot oil in the fourth pilot oil passage PA14.

The target rotation speed RSi is a target rotation speed of the hydraulic motors (31L, 31R) when the work vehicle 1 is assumed to travel straight. In the present embodiment, the secondary pilot pressure is an example of a control parameter for setting the displacement volume of the hydraulic pumps (7L, 7R) configured to supply the hydraulic motors (31L, 31R) with the hydraulic fluid. In the present embodiment, the secondary pressure control valve CV2 is an example of the control mechanism (hydraulic control circuit) configured to control the hydraulic pressure of the pilot oil that changes the displacement volume of the hydraulic pumps (31L, 31R). Since the secondary pilot pressure is determined based on the current applied to the solenoid of the secondary pressure control valve CV2 (control mechanism, hydraulic control circuit), the control parameter may be a current value (control current value) for controlling the secondary pressure control valve CV2 (control mechanism, hydraulic control circuit). In the present embodiment, the control parameter is a current value for controlling the secondary pressure control valve CV2 (hydraulic control circuit, control mechanism).

Figure 12:
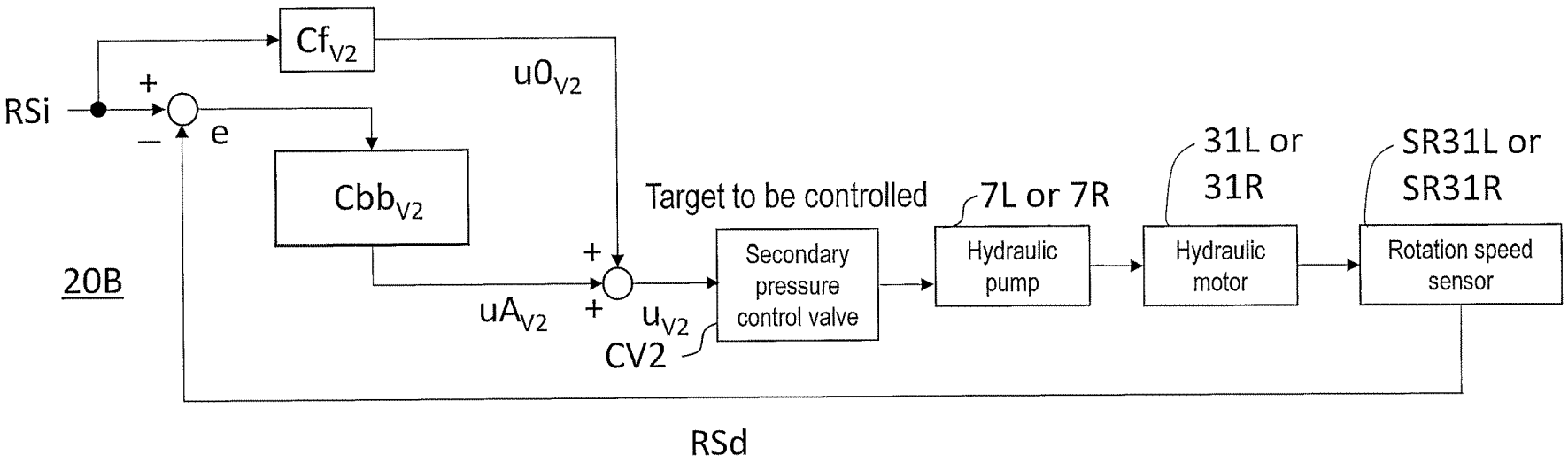
FIG. 12 is a control block diagram according to the second embodiment.

FIG. 12 is a control block diagram in the second embodiment. The control system 20B according to the second embodiment is different from the control system 20A according to the first embodiment mainly in that the control target is the secondary pressure control valve CV2, but is the same as the control system 20A in most parts, and thus the difference will be mainly described. The control system 20B includes a feedforward controller $Cf_{v2}$ and a feedback controller $Cbb_{v2}$. The feedforward controller $Cf_{v2}$ outputs the control current value $u0_{V2}$ of the secondary pressure control valve CV2 and the additional secondary pressure control valve ACV2 corresponding to the target rotation speed RSi of the hydraulic motor (31L, 31R). Since the work vehicle 1 is normally moved straight when starting to travel, the control current value $u0_{v2}$ of the proportional valves CV21 and CV22 (secondary pressure control valve CV2) may be the same. The memory 10*b* stores a list or a conversion formula of the control current value $u0_{V2}$ corresponding to the target rotation speed RSi. The processor 10*a*, which executes the feedforward controller $Cf_{v2}$, derives the control current value $u0_{V2}$ from the calculated target rotation speed RSi by using a stored list or a conversion formula. The determined control current value $u0_{V2}$ is the reference value of the control parameter according to the second embodiment.

The control current value $u0_{V2}$ is preferably derived from the target rotation speed RSi based on the following. As described above, the processor 10*a* determines the reference value $u0_{v2}$ of the control current value of the secondary pressure control valve CV2 and the additional secondary pressure control valve ACV2 so that the hydraulic motors (31L, 31R) rotate at the target rotation speed RSi in a state where the left and right traveling devices (3L, 3R) do not receive resistance from the road surface when the rotation speed of the engine 6 in the creep mode is known from the target rotation speed RSi and the secondary pilot pressure corresponding to the target rotation speed RSi is applied to the hydraulic pumps.

The feedback controller $Cbb_{v2}$ derives an offset value $uA_{V2}$ corresponding to a speed difference e (eL, eR) obtained by subtracting the target rotation speed RSi from the rotation speed (RSdL, RSdR) of the hydraulic motor (31L, 31R) detected by the rotation speed sensor (SR31L, SR31R) at every sampling interval Ts, the speed difference e having a larger absolute magnitude. The processor 10*a* is configured to receive the rotation speeds (RSdL, RSdR) of the hydraulic motors (31L, 31R) detected at every sampling interval Ts from the rotation speed sensors (SR31L, SR31R) and calculate the speed difference e (eL, eR) obtained by subtracting the target rotation speed RSi from the rotation speeds (RSdL, RSdR) at every sampling interval Ts.

The processor 10*a* is configured to calculate the offset value $uA_{V2}$ corresponding to the speed difference e having a larger absolute magnitude of the speed differences e (eL, eR) at every sampling interval Ts. Then, the processor 10*a* inputs the sum of the reference value $u0_{V2}$ and the offset value $uA_{V2}$ to the secondary pressure control valve CV2 and the additional secondary pressure control valve ACV2 as the control parameter $u_{V2}$. That is, the processor 10*a* applies the current of the control current value $u0_{V2}$ to the solenoid of the secondary pressure control valve CV2. The processor 10*a* sends a command corresponding to the control parameter $u_{V2}$ to the secondary pressure control valve CV2 (control mechanism, hydraulic control circuit) which controls the displacement volume of the hydraulic pumps (7L, 7R). The processor 10*a* thereby controls the displacement volume of the hydraulic pumps (7L, 7R) in response to the control parameter $u_{V2}$ described above. The processor 10*a* rotates the hydraulic motors (31L, 31R) by controlling the engine 6 to rotate the hydraulic pumps (7L, 7R).

The processor 10*a* updates the control parameter $u_{V2}$ at every sampling interval Ts. More specifically, the processor 10*a* updates the offset value $uA_{V2}$ at every sampling interval Ts. The updating method and the thresholds af, −ae, and ag (see FIG. 8) of the speed difference may be the same as those in the first embodiment. The first feedback control value $-d1_{v2}$, the second feedback control value $+d2_{V2}$, the third feedback control value $+d3_{v2}$, and the upper limit value $u_{maxv2}$ may be different from the first feedback control value $-d1_{v1}$, the second feedback control value $+d2_{v1}$, the third feedback control value $+d3_{v1}$, and the upper limit value $u_{maxv1}$ of the first embodiment, based on the difference in the characteristics of the valves of the primary pressure control valve CV1 and the secondary pressure control valve CV2.

However, the magnitude relationship of the absolute values of the first feedback control value $d1_{v2}$, the second feedback control value $d2_{v2}$, the third feedback control value $d3_{v2}$, and the upper limit value $u_{maxv2}$ is the same as that in the first embodiment. Thus, the offset value $uA_{V1}$ can be rapidly decreased to prevent the work vehicle 1 from being excessively accelerated due to a large decrease in the travel resistance at the start of movement, and the offset value $uA_{V1}$ can be rapidly increased when the torque of the hydraulic motor (31L, 31R) is required from the standstill to the start of movement, so that the time until the start of travel can be shortened.

Figure 13:
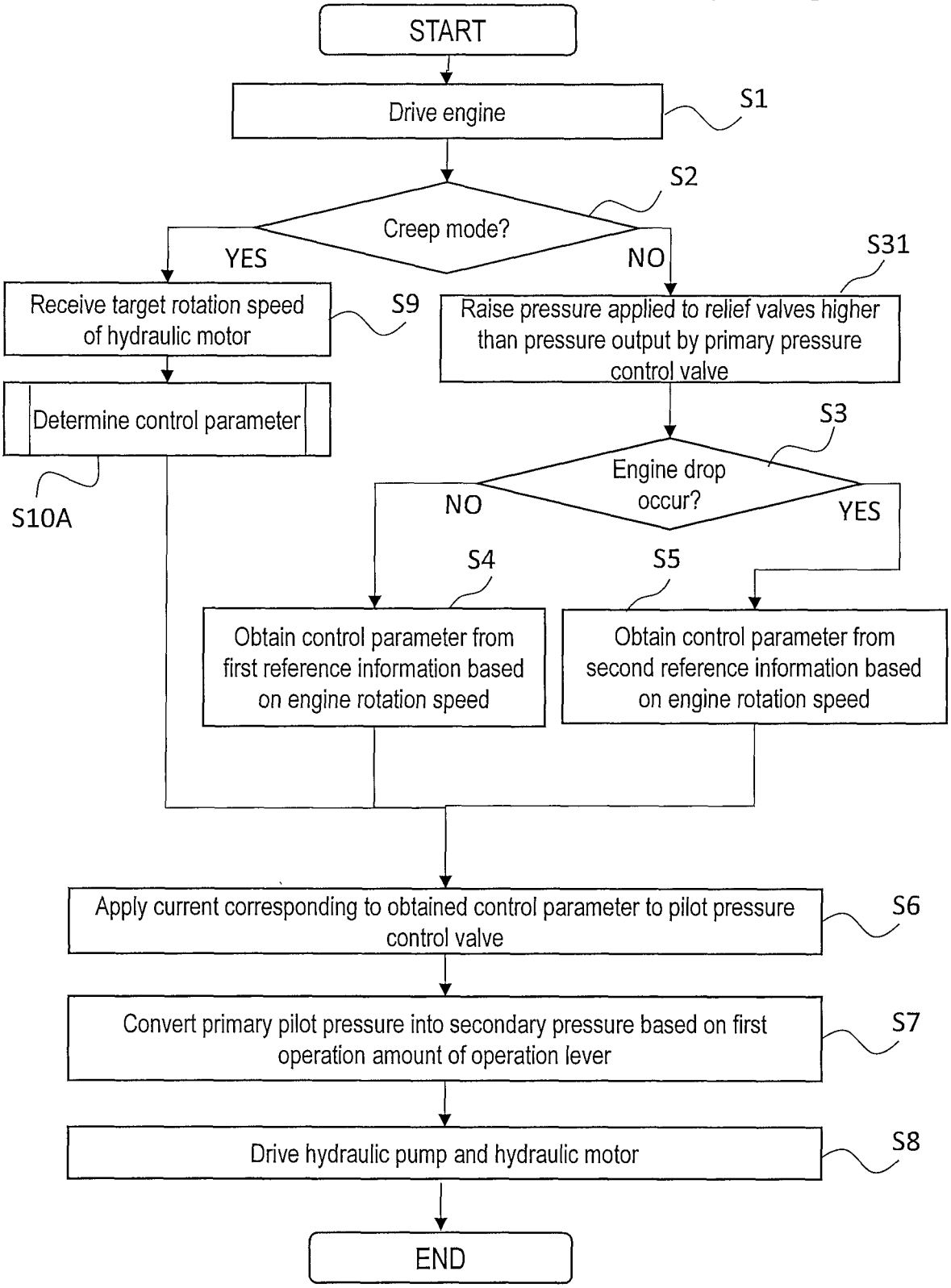
FIG. 13 is a flowchart showing the operation of the work vehicle according to the second embodiment.

FIG. 13 is a flowchart showing the operation of the work vehicle 1 according to the second embodiment. In this flowchart, the processing from step S1 to step S31 is executed at every predetermined sampling interval Ts (for example, 20 s). In FIG. 13, the same processes as those in FIG. 9 are denoted by the same step numbers, and the description thereof will be omitted. In the normal mode (Yes in step S2), in step S31, the processor 10*a* controls the proportional valves CV21 and CV22 so that the pressures applied to the relief valves CV23 and CV24 are higher than the pressures output by the primary pressure control valve CV1 as described above. Thereby, relief valves CV23, CV24 are closed.

In the creep mode (Yes in step S2), in step S10A after step S9, the processor 10*a* executes the processing of the feedforward controller $Cf_{v2}$ and the feedback controller $Cbb_{v2}$, and outputs the control parameter $u_{V2}$. That is, the control method according to the present embodiment includes determining the control parameter $u_{V2}$ for setting the displacement volume of the hydraulic pumps (7L, 7R) configured to supply the hydraulic motors (31L, 31R) with the hydraulic fluid in response to the operation of the creep setting member 16. The determination method is the same as that in the first embodiment.

Operation and Effects of Second Embodiment

In the method of controlling the work vehicle 1 or the work vehicle 1 according to the second embodiment, as in the first embodiment, even when the travel resistance is large, the secondary pilot pressure can be controlled so that the travel can be started quickly. In addition, in the control method or the work vehicle 1, it is possible to perform control of the secondary pilot pressure that can suppress the work vehicle 1 from accelerating too much due to a large decrease in the travel resistance at the start of movement.

Modification of Second Embodiment

Figure 14:
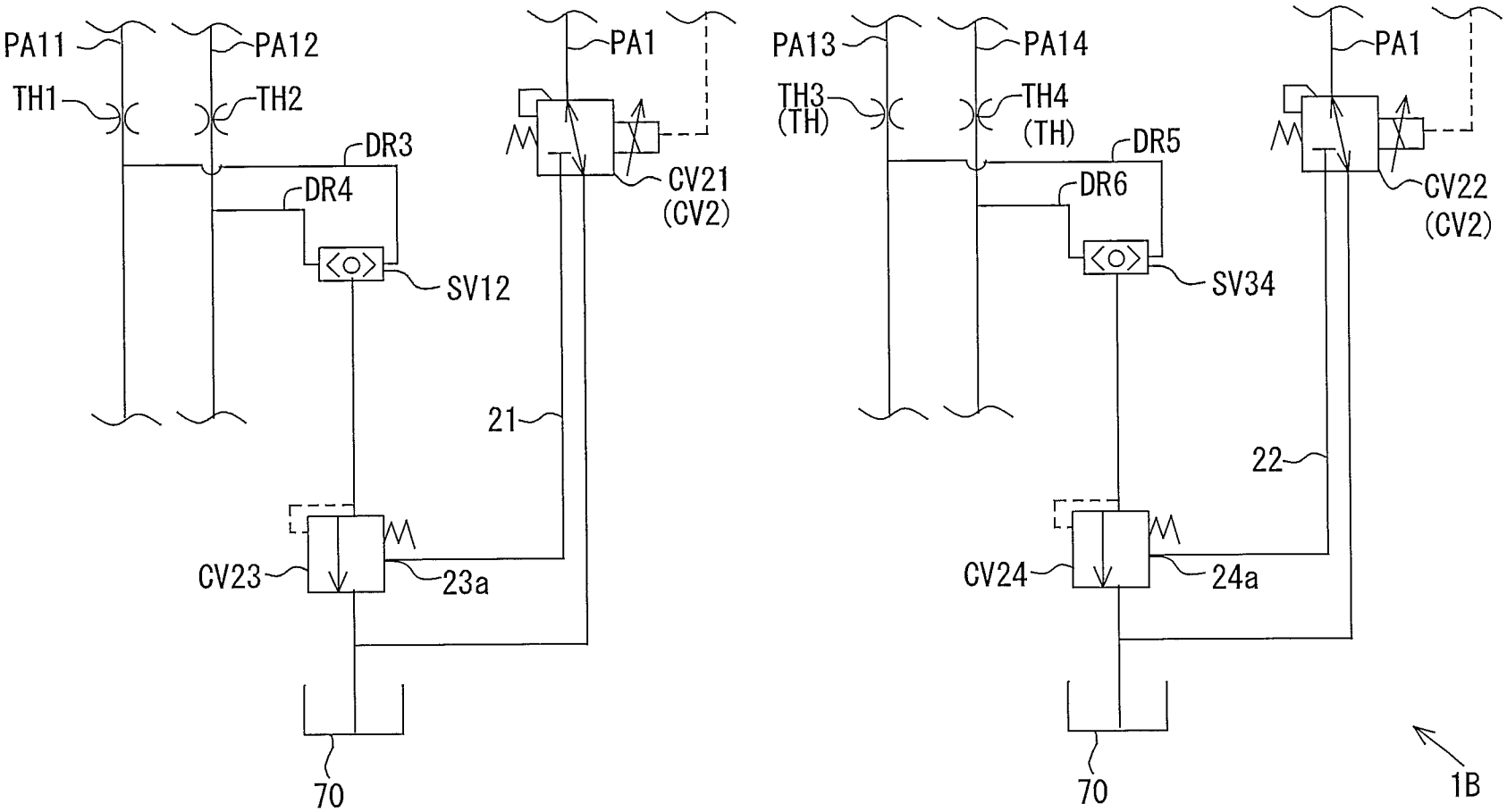
FIG. 14 is a hydraulic circuit diagram of a travel system of the work vehicle in a modified example of the second embodiment.

FIG. 14 is a hydraulic circuit diagram according to a modification of the second embodiment. In the example of FIG. 14, shuttle valves SV12 and SV34 are provided instead of the check valves CK1 to CK4 of the example of FIG. 11. The shuttle valve SV12 connects the discharge oil passage DR3 or the oil passage with the higher hydraulic pressure of the discharge oil passage DR4 to the relief valve CV23. The shuttle valve SV34 connects the discharge oil passage DR5 or the oil passage with the higher hydraulic pressure of the discharge oil passage DR6 to the relief valve CV24. Even with this configuration of the hydraulic circuit, the above-described control can be executed. In the circuit of FIG. 11 or 14, the primary pressure control valve CV1 may be omitted. Further, at least one of the combinations of the proportional valves CV21 and the balanced relief valve and the combination of the proportional valve CV21 and the balanced relief valve may be realized by the proportional solenoid relief valve.

Figure 15:
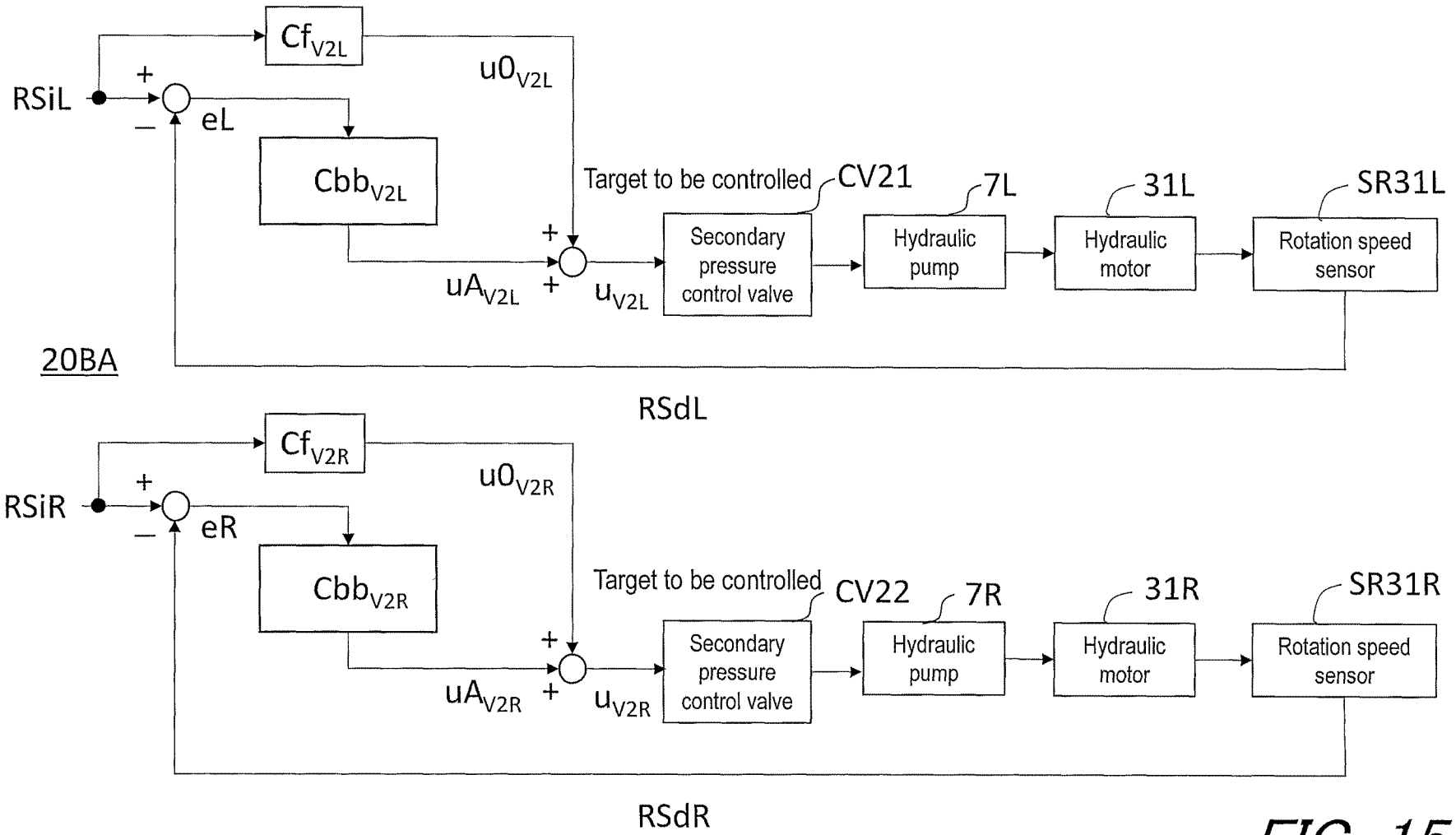
FIG. 15 is a control block diagram in the modified example of the second embodiment.

As a modification of the second embodiment, the control system 20B may be a combination of the feedback controller Cbv2 described in United States Patent Application Publication No. 2024/0060274 A1 as a feedback controller. Alternatively, the control system 20A may be a combination of the feedback controllers $Cb_{v21}$ and $Cb_{v22}$ described in United States Patent Application Publication No. 2024/0060274 A1 as a feedback controller. In the second embodiment described above, the hydraulic pumps (7L, 7R) and the hydraulic motors (31L, 31R) are controlled by the same feedback loop. However, the control of the left hydraulic pumps 7L and the left hydraulic motors 31L and the control of the right hydraulic pumps 7R and the right hydraulic motors 31R may be controlled by separate feedback loops. FIG. 15 is a control block diagram of a modification of the second embodiment.

Referring to FIG. 15, the control system 20BA according to the present modification includes a feedforward controller $Cf_{v2L}$ and a feedback controller $Cbb_{2vL}$ for controlling the left hydraulic pump 7L and the left hydraulic motor 31L, and a feedforward controller $Cf_{v2L}$ and a feedback controller $Cbb_{v2R}$ for controlling the right hydraulic pump 7R and the right hydraulic motor 31R. The feedforward controller $Cf_{v2L}$ outputs a control current value $u0_{v2L}$ of the proportional valve CV21 corresponding to the target rotation speed RSiL of the hydraulic motor 31L. The feedforward controller $Cf_{v2R}$ outputs a control current value $u0_{V2R}$ of the proportional value CV22 corresponding to the target rotation speed RSiR of the hydraulic motor 31R. Since the work vehicle 1 is normally moved straight at the start of travel, the target rotation speed RSiL of the hydraulic motor 31L and the target rotation speed RSiR of the hydraulic motor 31R may be the same.

The feedback controller $Cbb_{v2L}$ derives an offset value $uA_{v2L}$ corresponding to a speed difference eL obtained by subtracting the target rotation speed RSiL from the rotation speed RSdL of the hydraulic motor 31L detected by the rotation speed sensor SR31L at every sampling interval Ts. The feedback controller $Cbb_{v2R}$ derives an offset value $uA_{v2R}$ corresponding to a speed difference eR obtained by subtracting the target rotation speed RSiR from the rotation speed RSdR of the hydraulic motor 31R detected by the rotation speed sensor SR31R at every sampling interval Ts.

The processor 10*a* inputs the sum of the reference value $u0_{V2L}$ and the offset value $uA_{V2L}$ to the proportional valve CV21 as the control parameter $u_{v2L}$. That is, the processor 10*a* applies the current of the control current value $u_{V2L}$ to the solenoid of the proportional valve CV21. The processor 10*a* thereby controls the displacement volume of the hydraulic pump 7L in response to the control parameter $u_{v2L}$ as described above. The processor 10*a* inputs the sum of the reference value $u0_{V2R}$ and the offset value $uA_{V2R}$ to the proportional valve CV22 as the control parameter $u_{V2R}$. That is, the processor 10*a* applies the current of the control current valve $u_{V2R}$ to the solenoid of the proportional valve CV22. The processor 10*a* thereby controls the displacement volume of the hydraulic pump $u_{V2R}$ in response to the control parameters $u_{V2R}$ described above. As described above, the control of the left hydraulic pump 7L and the left hydraulic motor 31L and the control of the right hydraulic pump 7R and the right hydraulic motor 31R can be performed separately.

Third Embodiment

Figure 16:
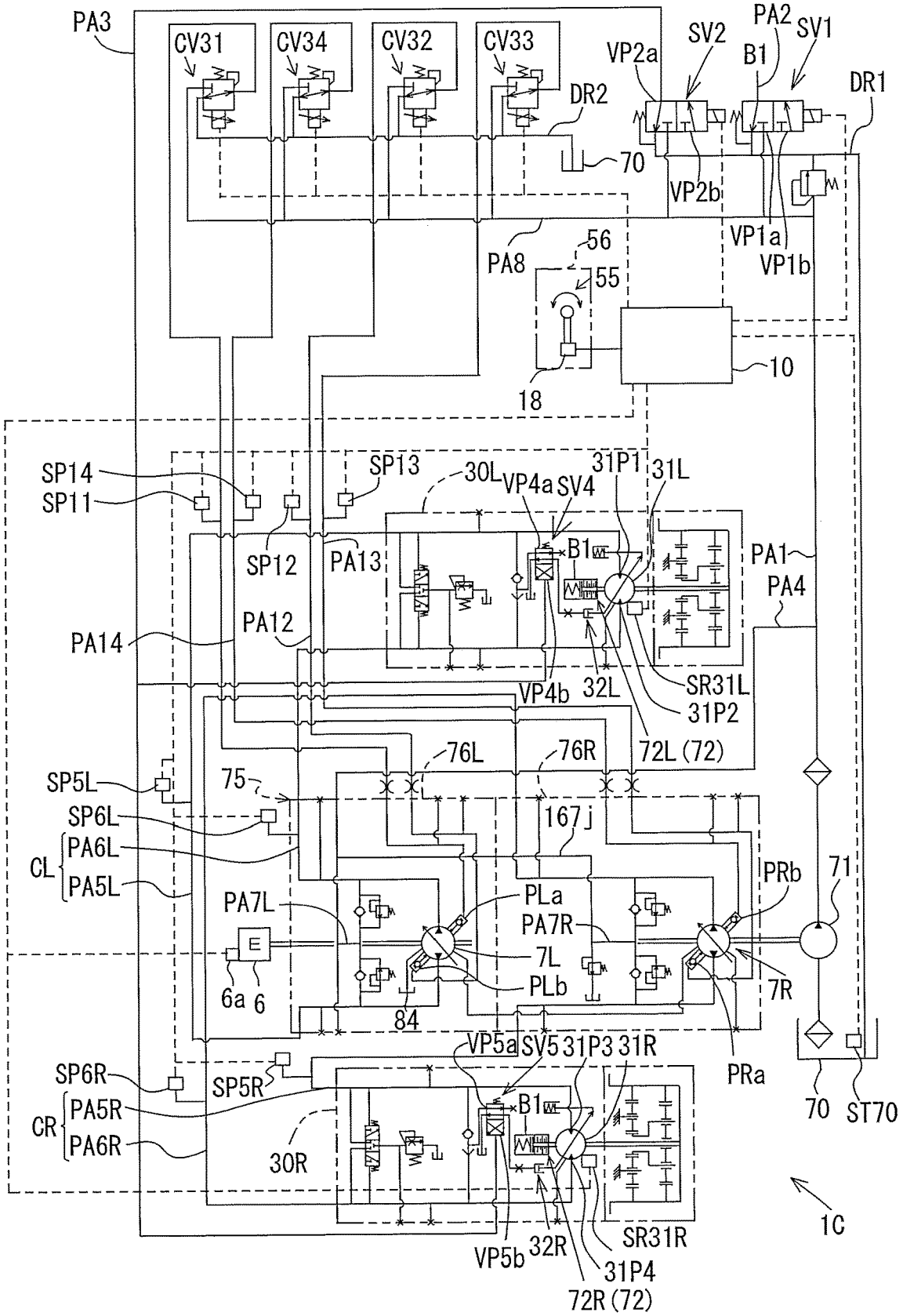
FIG. 16 is a hydraulic circuit diagram of the travel system of the work vehicle in the third embodiment.

Although the operation lever 55 according to the above-described embodiment directly controls the operation valves OVA, OVB, OVC, and OVD, the work vehicle 1 may detect the operation amount of the operation lever 55 by a separate sensor such as a potentiometer and control a control valve that controls the first pump pilot pressure and the second pump pilot pressure based on the operation amount detected by the sensor. In this case, the same control as that of the second embodiment can be realized by adjusting the operation amount detected by the sensor. FIG. 16 is a hydraulic circuit diagram of the travel system of the work vehicle 1 in the third embodiment. In FIG. 16, the same components as those in FIG. 3 are denoted by the same reference numerals, and detailed description thereof will be omitted. In the third embodiment, the work vehicle 1 includes a hydraulic circuit 1C. The hydraulic circuit 1C may include a pilot control valves CV31 to CV34 for controlling the pilot pressure applied to each of the ports (PLa, PRa, PLb, PRb), instead of the operation valves OVA, OVB, OVC, OVD and the first to fourth shuttle valves SVa, SVb, SVc, SVd. The pilot control valves CV31 to CV34 are electromagnetic proportional valves including solenoids.

In the present embodiment, the pilot oil supply passage PA8 connects the pilot control valves CV31 to CV34 and the pilot oil supply passage PA8, and the first to fourth pilot oil passages PA11 to PA14 are connected to the pilot control valves CV31 to CV34, respectively. In the present embodiment, the pilot oil supply passages PA1 and PA8 and the first to fourth pilot oil passages PA11 to PA14 correspond to a pilot oil supplying circuit that connects the pilot pump and the first pump pilot port or the second pump pilot port. In the present embodiment, since the operation valves OVA, OVB, OVC, and OVD are not provided, there is no difference between the primary pilot pressure and the secondary pilot pressure. Therefore, in the present embodiment, these pressures are simply referred to as pilot pressures without being distinguished from each other.

In the normal mode, the controller 10 is configured to control the pilot control valves CV31 to CV34 in order to output the pilot pressure corresponding to FIG. 5 in accordance with the operation position detected by the operation detection sensor 18. In the creep mode, in order to limit the vehicle speed, even when the operation lever 55 is actually operated at the full stroke, the operation lever 55 is regarded as being operated to the deemed operation position Ga. Specifically, when the operation position is from the G0 position to the Ga position, the pilot pressure is obtained from the correspondence relationship of FIG. 5 in correspondence with the operation position detected by the operation detection sensor 18. When the operation position is equal to or more than the Ga position, it is regarded that the operation is performed at the deemed operation position Ga. In the present embodiment, the operation amount from the G0 position to the Ga position is referred to as a deemed operation amount r.

The target rotation speed RSi is a target rotation speed of the hydraulic motors (31L, 31R) when the work vehicle 1 is assumed to travel straight. In the present embodiment, the deemed operation amount r is an example of a control parameter for setting the displacement volume of the hydraulic pumps (7L, 7R) configured to supply the hydraulic motors (31L, 31R) with the hydraulic fluid. Note that the control parameter may be the output pressure of the pilot control valves CV31 to CV34, but is substantially the same as that in the second embodiment, and thus the description thereof will be omitted. In the present embodiment, the pilot control valves CV31 to CV34 are an example of the control mechanism (hydraulic control circuit) configured to control the hydraulic pressure of the pilot oil for changing the displacement volumes of the hydraulic pumps (31L, 31R).

Figure 17:
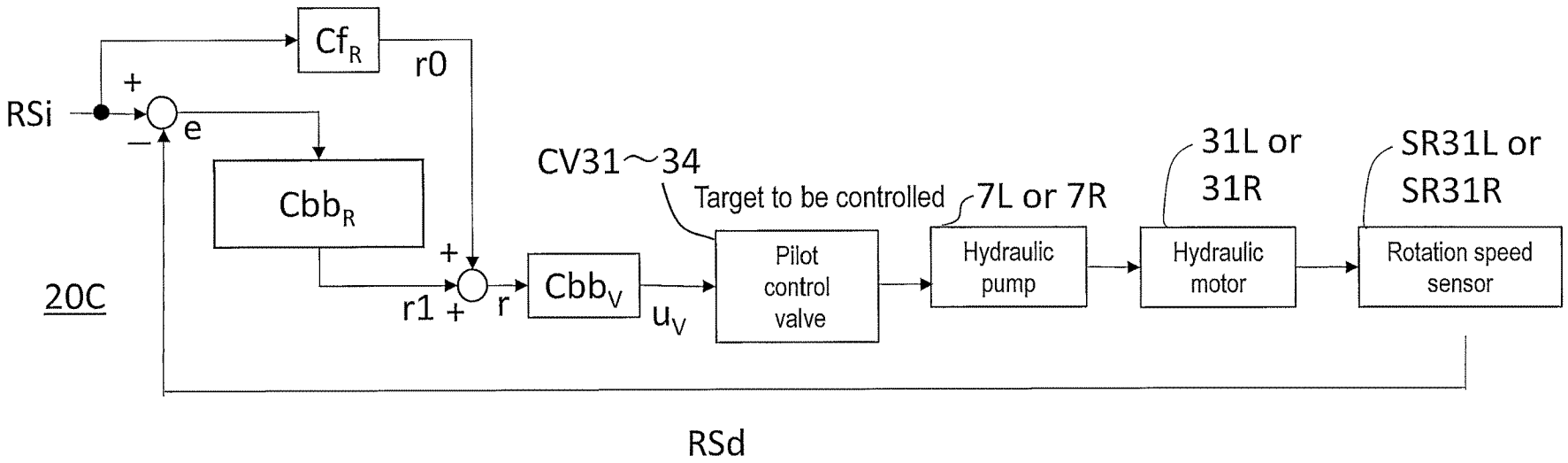
FIG. 17 is a control block diagram according to the third embodiment.

FIG. 17 is a control block diagram according to the third embodiment. The control system 20C according to the third embodiment is different from the control system 20A according to the first embodiment mainly in that the control target is the deemed manipulated variable r, but is the same as the control system 20A in most parts, and thus the different points will be mainly described. The control system 20C includes a feedforward controller $Cf_R$ a feedback controller $Cbb_R$, a converter $Cbb_v$. The feedforward controller $Cf_R$ outputs the deemed reference operation amount r0 corresponding to the target rotation speed RSi of the hydraulic motor (SR31L, SR31R). The deemed reference manipulated variable r0 is referred to as a reference value of the control parameter r. The memory 10*b* stores a list or conversion formula defining the deemed operation amount r0 corresponding to the target rotation speed RSi. The processor 10*a* that executes the feedforward controller $Cf_R$ derives the deemed operation amount r0 from the target rotation speed RSi by using a stored list or conversion formula.

The feedback controller $Cbb_R$ derives the deemed adjustment operation amount r1 corresponding to the speed difference e having a larger absolute magnitude among the speed differences e (eL, eR) obtained by subtracting the target rotation speed RSi from the rotation speeds (RSdL, RSdR) of the hydraulic motors (31L, 31R) detected by the rotation speed sensors (SR31L, SR31R) at every sampling interval Ts. The deemed adjustment amount r1 is referred to as an offset value of the control parameter. Then, the processor 10*a* sets the sum of the deemed reference manipulated variable r0 and the deemed adjustment manipulated variable r1 as a deemed manipulated variable (control parameter) r. The converter $Cbb_v$ holds the relationship between the deemed operation amount r and the pilot pressure Pt as shown in FIG. 5, and outputs the control current value $u_V$ of the pilot control valves CV31 to CV34 corresponding to the pilot pressure Pt.

The processor 10*a* updates the control parameter r at every sampling interval Ts. More specifically, the processor 10*a* updates the offset value r1 at every sampling interval Ts. The updating method and the thresholds af, −ae, and ag (see FIG. 8) of the speed difference e may be the same as those in the first embodiment. However, in the present embodiment, since the position of the operation lever 55 is detected by the operation detection sensor 18, whether the operation lever 55 is in the neutral position or has shifted from the neutral position is determined by determining whether the operation lever 55 has shifted from the position corresponding to the neutral region RA1 that is shown in FIG. 5 based on the output of the operation detection sensor 18. Further, the values of the first feedback control value $-d1_r$, the second feedback control value $+d2_r$, the third feedback control value $+d3_r$, and the upper limit value $u_{maxr}$ may be different from the first feedback control value $-d1_{v1}$, the second feedback control value $+d2_{v1}$, the third feedback control value $+d3_{v1}$, and the upper limit value $u_{maxv1}$ of the first embodiment based on the difference in the characteristics of the control system.

However, the magnitude relationship of the absolute values of the first feedback control value $d1_r$, the second feedback control value $d2_r$, the third feedback control value $d3_r$, and the upper limit value $u_{maxr}$ is the same as that in the first embodiment. Thus, the offset value r1 can be rapidly decreased to prevent the work vehicle 1 from being excessively accelerated due to a large decrease in the travel resistance at the start of movement, and the offset value r1 can be rapidly increased when the torque of the hydraulic motor (31L, 31R) is required from the standstill to the start of movement, so that the time until the start of travel can be shortened.

Figure 18:
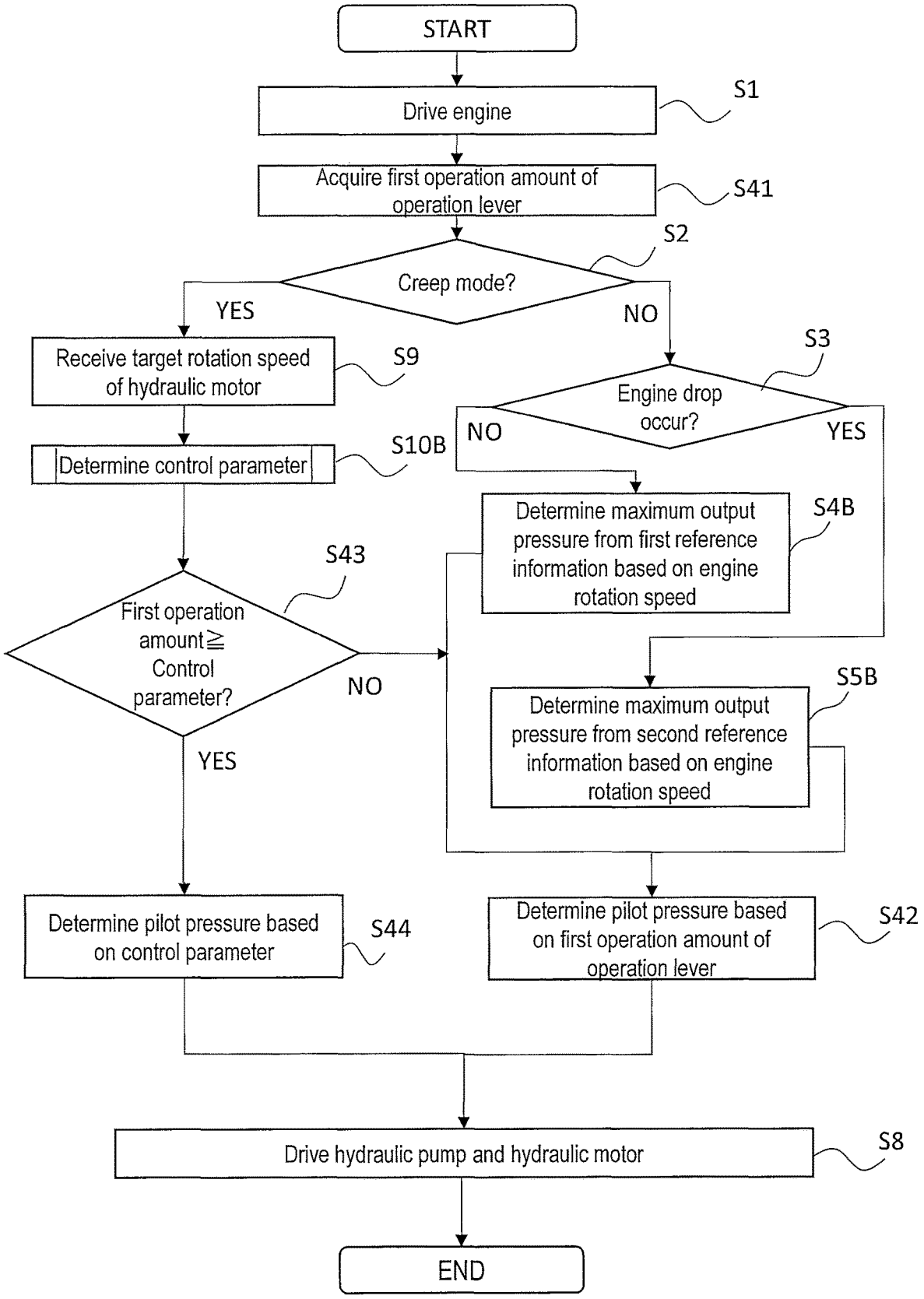
FIG. 18 is a flowchart showing the operation of the work vehicle according to the third embodiment.

FIG. 18 is a flowchart showing the operation of the work vehicle 1 according to the third embodiment. In FIG. 18, the same operations as those in the first embodiment are denoted by the same reference numerals, and detailed description thereof will be omitted. In this flowchart, the processing from step S1 to step S44 is executed at every predetermined sampling interval (for example, 20 s). After the end of step S1, in step S41, the processor 10*a* acquires the first operation amount from the operation detection sensor 18. That is, the operation amount r of the feedback control is set to the operation amount of the travel instruction input device (the operation lever 55) to which the instruction of the traveling direction is input by the user.

When the engine drop does not occur (No in step S3), in step S4B, the processor 10*a* determines the maximum output pressure (Pc) of FIG. 5 from the first reference information 10*r*1 based on the rotation speed RS of the engine 6. When engine drop is present (Yes in step S3) in step S5B, the processor 10*a* is configured to determines maximum output pressure (Pc) in FIG. 5 from the second reference information 10*r*2 based on the rotation speed RS of the engine 6. After the end of step S4B or step S5B, in step S42, the processor 10*a* determines the pilot pressure in accordance with the first operation amount in a state where the maximum output pressure (Pc) is limited, and controls the pilot control valves CV31 to CV34 such that the determined pilot pressure is applied.

In step S10B instead of step S10, the processor 10*a* executes the processing of the feedforward controller $Cf_R$ and the feedback controller $Cbb_R$, and outputs the control parameter r. That is, the control method according to the present embodiment includes determining the control parameter r for setting the displacement volume of the hydraulic pumps (7L, 7R) configured to supply the hydraulic motors (31L, 31R) with the hydraulic fluid in response to the operation of the creep setting member 16. The determination method is the same as that of the first embodiment except that the determination of whether the operation lever 55 is in the neutral position or has shifted from the neutral position is performed from the output of the operation detection sensor 18 because the position of the operation lever 55 is detected by the operation detection sensor 18, and the determination of whether the operation lever 55 has deviated from the position corresponding to the neutral region RA1 in FIG. 5 is performed.

Thereafter, in step S43, the processor 10*a* is configured to determine whether the first operation amount is equal to or larger than the deemed operation amount r. In the creep mode, the first operation amount is normally operated to be equal to or larger than the deemed operation amount r. When the first operation amount is smaller than the deemed operation amount (control parameter) r (No in step S43), the process proceeds to step S42. When the first operation amount is equal to or larger than the control parameter r (Yes in Step S43), in step S44, the processor 10*a* determines the pilot pressure according to the control parameter r, and controls the pilot control valves CV31 to CV34 so that the determined pilot pressure is applied.

Operation and Effects of Third Embodiment

In the method for controlling the work vehicle 1 or the work vehicle 1 according to the third embodiment, as in the first embodiment, for example, even when the travel resistance is large at the start of travel of the work vehicle, the travel can be started quickly. In addition, in the control method or the work vehicle 1, it is possible to prevent the work vehicle 1 from being excessively accelerated due to a large decrease in the travel resistance at the start of movement.

Modified Example of Third Embodiment

Instead of the third embodiment, the ports (PLa, PRa, PLb, PRb) of the hydraulic pumps (7L, 7R) may be configured to receive electromagnetic input, such as solenoids. In this case, the pilot control valves CV31 to 34 may be omitted. In this case, the control current value $u_V$ is input to the solenoids of the hydraulic pumps (7L, 7R). Instead of the pilot control valves CV31 to 34, devices that are provided in the hydraulic pumps (7L, 7R) and electromagnetically input may be regarded as the control mechanism (hydraulic control circuit).

In addition to the above embodiments, the control system 20A may be combined with a feedback controller $Cb_R$ described in United States Patent Application Publication No. 2024/0060274 A1 as a feedback controller. Alternatively, the control system 20A may be a combination of the feedback controllers $Cb_{R1}$ and $Cb_{R2}$ described in United States Patent Application Publication No. 2024/0060274 A1 as a feedback controller. In the third embodiment, as in the second embodiment, the control of the left hydraulic pump 7L and the left hydraulic motor 31L and the control of the right hydraulic pump 7R and the right hydraulic motor 31R may be controlled by separate feedback loops.

Modified Examples of all Embodiments

In the above-described embodiment, the case where the hydraulic pumps (7L, 7R) are rotated by the engine 6 has been described, but the hydraulic pumps (7L, 7R) may be rotated by another prime mover such as an electric motor.

The values of the various thresholds may be changed according to the characteristics of the left hydraulic pump 7L, the right hydraulic pump 7R, the left hydraulic motor 31L, and the right hydraulic motor 31R, the characteristics of the reduction gear connected to the left hydraulic motor 31L and the reduction gear connected to the right hydraulic motor 31R, and the characteristics of the various control valves.

The control systems 20A to 20C may further include other control such as D control in addition to the above example.

In this application, the word "comprise" and its derivatives are used as open-ended terms to describe the presence of elements but not to exclude the presence of other elements not listed. This applies to "having", "including" and derivatives thereof.

The terms "member," "part," "element," "body," and "structure" may have a plurality of meanings, such as a single portion or a plurality of portions.

The ordinal numbers such as "first" and "second" are merely terms for identifying the configuration, and do not have other meanings (for example, a specific order). For example, the presence of a "first element" does not imply the presence of a "second element," and the presence of a "second element" does not imply the presence of a "first element."

Terms of degree such as "substantially", "about", and "approximately" can mean a reasonable amount of deviation such that the end result is not significantly changed, unless the embodiment is specifically described otherwise. All numerical values recited herein may be construed to include terms such as "substantially," "about," and "approximately."

The phrase "at least one of A and B" as used herein should be interpreted to include A alone, B alone, and both A and B.

Obviously, numerous modifications and variations of the present invention are possible in light of the above teachings. Thus, it is to be understood that the invention may be practiced otherwise than as specifically described herein without departing from the scope of the invention.

What is claimed is:

1. A work vehicle comprising:

a hydraulic motor configured to generate a driving force of the work vehicle;

a hydraulic pump configured to supply hydraulic fluid to the hydraulic motor;

a prime mover configured to rotate the hydraulic pump;

a human-machine interface configured to receive an input corresponding to a target rotation speed of the hydraulic motor;

a rotation speed sensor configured to detect a rotation speed of the hydraulic motor;

a hydraulic control circuit configured to control a hydraulic pressure of pilot oil to change a displacement volume of the hydraulic pump; and circuitry configured to control the prime mover and the hydraulic control circuit, the circuitry being configured to:

obtain based on the target rotation speed, a reference value of a control parameter according to which the hydraulic control circuit is controlled;

calculate a speed difference obtained by subtracting the target rotation speed from the rotation speed;

calculate an offset value corresponding to the speed difference; and set the control parameter to a value obtained by adding the offset value to the reference value, wherein the circuitry is configured to update the offset value by:

subtracting a first feedback control value from the offset value to reduce the displacement volume when the speed difference is greater than a first threshold value that is a predetermined positive value;

adding a second feedback control value to the offset value to increase the displacement volume when the speed difference is smaller than a second threshold value that is a predetermined negative value; and keeping the offset value unchanged when the speed difference is between the second threshold value and the first threshold value.

2. The work vehicle according to claim 1, wherein the circuitry is configured to add a third feedback control value, which is greater than the second feedback control value, to the offset value when an indicated position of the human-machine interface is changed from a return position to which the indicated position of human-machine interface is returned when the human-machine interface is not operated.

3. The work vehicle according to claim 2, wherein the human-machine interface includes an operation lever, and wherein the return position is a neutral position of the operation lever.

4. A work vehicle comprising:

a hydraulic motor configured to generate a driving force of the work vehicle;

a hydraulic pump configured to supply hydraulic fluid to the hydraulic motor;

a prime mover configured to rotate the hydraulic pump;

a human-machine interface configured to receive an input corresponding to a target rotation speed of the hydraulic motor;

a rotation speed sensor configured to detect a rotation speed of the hydraulic motor;

a hydraulic control circuit configured to control a hydraulic pressure of pilot oil to change a displacement volume of the hydraulic pump; and circuitry configured to control the prime mover and the hydraulic control circuit, the circuitry being configured to:

obtain based on the target rotation speed, a reference value of a control parameter according to which the hydraulic control circuit is controlled;

calculate a speed difference obtained by subtracting the target rotation speed from the rotation speed;

calculate an offset value corresponding to the speed difference; and set the control parameter to a value obtained by adding the offset value to the reference value, wherein the circuitry is configured to set the offset value to zero when the speed difference is larger than a third threshold value which is larger than a first threshold value.

5. The work vehicle according to claim 1, wherein the circuitry is configured to set the control parameter to a predetermined upper limit value when a value obtained by adding the offset value to the reference value exceeds the upper limit value.

6. The work vehicle according to claim 1, wherein an absolute value of the first feedback control value is larger than an absolute value of the second feedback control value.

7. The work vehicle according to claim 1, wherein the control parameter is a current value to control the hydraulic control circuit.

8. The work vehicle according to claim 1, wherein the rotation speed sensor is configured to detect the rotation speed at every sampling interval, and wherein the circuitry is configured to calculate the speed difference and the offset value to set the control parameter to the value at every sampling interval.

9. A controller of the work vehicle, comprising:

operation detection circuitry configured to receive an input from a human-machine interface, the input corresponding to a target rotation speed of a hydraulic motor configured to generate a driving force of the work vehicle;

determination circuitry configured to determine a control parameter according to which a displacement volume of a hydraulic pump is controlled in response to an operation of the human-machine interface, the hydraulic pump being configured to supply hydraulic fluid to the hydraulic motor;

pump control circuitry configured to send a command corresponding to the control parameter to a hydraulic control circuit to control the displacement volume of the hydraulic pump;

prime mover control circuitry configured to send a command to a prime mover configured to rotate the hydraulic pump to rotate the hydraulic motor via the hydraulic pump;

motor rotation detection circuitry configured to receive a rotation speed of the hydraulic motor from a rotation speed sensor; and the determination circuitry being configured to:

calculate a speed difference obtained by subtracting the target rotation speed from the rotation speed; and obtain a reference value of the control parameter based on the target rotation speed;

calculate an offset value corresponding to the speed difference; and set the control parameter to a value obtained by adding the offset value to the reference value, wherein the determination circuitry being configured to calculate the offset value by:

subtracting a first feedback control value from the offset value to reduce the displacement volume when the speed difference is greater than a first threshold value that is a predetermined positive value;

adding a second feedback control value to the offset value to increase the displacement volume when the speed difference is smaller than a second threshold value that is a predetermined negative value; and keeping the offset value unchanged when the speed difference is between the second threshold value and the first threshold value.

10. The controller according to claim 9, wherein the determination circuitry is configured to receive the rotation speed, calculate the speed difference and the offset value, and set the control parameter to the value at every sampling interval.

11. A speed control method for a work vehicle, comprising:

acquiring from a human-machine interface, a target rotation speed of a hydraulic motor configured to generate a driving force of the work vehicle;

determining a control parameter according to which a displacement volume of a hydraulic pump is set based on an operation of the human-machine interface, the hydraulic pump being configured to supply hydraulic fluid to the hydraulic motor;

controlling the displacement volume of the hydraulic pump according to the control parameter to rotate the hydraulic pump to rotate the hydraulic motor;

detecting a rotation speed of the hydraulic motor;

calculating a speed difference obtained by subtracting the rotation speed from the target rotation speed;

obtaining a reference value of the control parameter based on the target rotation speed;

calculating an offset value corresponding to the speed difference; and setting the control parameter to a value obtained by adding the offset value to the reference value, wherein the calculating the offset value comprises:

subtracting a first feedback control value from the offset value to reduce the displacement volume when the speed difference is greater than a first threshold value that is a predetermined positive value, adding a second feedback control value to the offset value to reduce the displacement volume when the speed difference is smaller than a second threshold value that is a predetermined negative value, and keeping the offset value unchanged when the speed difference is between the second threshold value and the first threshold value.

12. The speed control method according to claim 11, wherein third feedback control value larger than the second feedback control value is added to the offset value when an indicated position of an additional human-machine interface is changed from a return position to which the indicated position is returned when the human-machine interface is not operated.

13. A speed control method for a work vehicle, comprising:

acquiring from a human-machine interface, a target rotation speed of a hydraulic motor configured to generate a driving force of the work vehicle;

determining a control parameter according to which a displacement volume of a hydraulic pump is set based on an operation of the human-machine interface, the hydraulic pump being configured to supply hydraulic fluid to the hydraulic motor;

controlling the displacement volume of the hydraulic pump according to the control parameter to rotate the hydraulic pump to rotate the hydraulic motor;

detecting a rotation speed of the hydraulic motor;

calculating a speed difference obtained by subtracting the rotation speed from the target rotation speed;

obtaining a reference value of the control parameter based on the target rotation speed;

calculating an offset value corresponding to the speed difference; and setting the control parameter to a value obtained by adding the offset value to the reference value, wherein the offset value is set to zero when the speed difference is larger than a third threshold value which is larger than a first threshold value.

14. The speed control method according to claim 11, wherein the control parameter is set to the upper limit value when a value obtained by adding the offset value to the reference value exceeds a predetermined upper limit value.

15. The speed control method according to claim 11, wherein an absolute value of the first feedback control value is larger than an absolute value of the second feedback control value.

16. The speed control method according to claim 11, wherein the control parameter is a current value according to which a hydraulic control circuit configured to control a hydraulic pressure of pilot oil to change a displacement volume of the first hydraulic pump.

17. The speed control method according to claim 11, wherein the detecting the rotation speed, the calculating the speed difference and the offset value, and the setting the control parameter to the value are conducted at every sampling interval.

18. The work vehicle according to claim 4, wherein the circuitry is configured to update the offset value by subtracting the first feedback control value from the offset value to reduce the displacement volume when the speed difference is greater than the first threshold value that is a predetermined positive value.

19. The speed control method according to claim 13, wherein the calculating the offset value comprises subtracting a first feedback control value from the offset value to reduce the displacement volume when the speed difference is greater than the first threshold value that is a predetermined positive value.

* * * * *